US011571739B2

(12) United States Patent
Yu et al.

(10) Patent No.: US 11,571,739 B2
(45) **Date of Patent: *Feb. 7, 2023**

(54) CLUSTER FOR AND METHOD OF CASTING GOLF CLUB HEADS

(71) Applicant: Taylor Made Golf Company, Inc, Carlsbad, CA (US)

(72) Inventors: Joseph Yu, Kaohsiung (TW); Bing-Ling Chao, San Diego, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/557,759

(22) Filed: Dec. 21, 2021

(65) Prior Publication Data

US 2022/0203432 A1 Jun. 30, 2022

Related U.S. Application Data

(63) Continuation of application No. 16/189,515, filed on Nov. 13, 2018, now Pat. No. 11,235,380.

(51) Int. Cl.

| | |
|---|---|
| ***B22D 11/04*** | (2006.01) |
| ***B22D 13/10*** | (2006.01) |
| ***A63B 53/04*** | (2015.01) |
| ***B22C 9/08*** | (2006.01) |

(Continued)

(52) U.S. Cl.

CPC ..... *B22D 11/0403* (2013.01); *A63B 53/0466* (2013.01); *B22C 9/082* (2013.01); *B22D 11/0405* (2013.01); *B22D 11/103* (2013.01); *B22D 13/04* (2013.01); *B22D 13/101* (2013.01)

(58) Field of Classification Search

CPC .. B22D 13/101; B22D 13/04; B22D 11/0403; B22D 11/0405; B22D 11/103

See application file for complete search history.

(56) References Cited

U.S. PATENT DOCUMENTS

| | | | |
|---|---|---|---|
| 4,754,969 | A | 7/1988 | Kobayashi et al. |
| 5,224,705 | A | 7/1993 | Scheie et al. |
| 5,836,830 | A | 11/1998 | Onuki et al. |

(Continued)

FOREIGN PATENT DOCUMENTS

| | | |
|---|---|---|
| CN | 2673540 Y | 1/2005 |
| JP | 62275557 | 11/1987 |
| JP | 08289945 | 11/1996 |

OTHER PUBLICATIONS

U.S. Appl. No. 11/528,989, filed Sep. 27, 2006.

*Primary Examiner* — Kevin P Kerns
*Assistant Examiner* — Steven S Ha
(74) *Attorney, Agent, or Firm* — Kunzler Bean & Adamson

(57) ABSTRACT

Disclosed herein is a casting cluster for casting a body of a golf club head made of titanium or a titanium alloy. The casting cluster comprises a receptor and a plurality of runners coupled to the receptor and configured to receive molten metal from the receptor. The casting cluster also includes at least twenty-eight main gates. At least two of the main gates are coupled to each of the runners and each main gate is configured to receive molten metal from a corresponding one of the plurality of runners. The casting cluster further comprises at least twenty-eight molds. Each mold of the at least twenty-eight molds is configured to receive molten metal from a corresponding one of the main gates and to cast a body of a golf club head that has a volume of at least 100 $cm^3$.

17 Claims, 16 Drawing Sheets

(51) Int. Cl.
*B22D 11/103* (2006.01)
*B22D 13/04* (2006.01)

(56) References Cited

U.S. PATENT DOCUMENTS

| | | | |
|---|---|---|---|
| 6,773,360 | B2 | 8/2004 | Willett et al. |
| 6,830,093 | B2 | 12/2004 | Bramley |
| 6,852,038 | B2 | 2/2005 | Yabu |
| 7,166,040 | B2 | 1/2007 | Bing-Ling et al. |
| 7,186,190 | B1 | 3/2007 | Beach et al. |
| 7,223,180 | B2 | 5/2007 | Willett et al. |
| 7,267,620 | B2 | 9/2007 | Chao et al. |
| 7,407,447 | B2 | 8/2008 | Beach et al. |
| 7,410,425 | B2 | 8/2008 | Willett et al. |
| 7,410,426 | B2 | 8/2008 | Willett et al. |
| 7,419,441 | B2 | 9/2008 | Hoffman et al. |
| 7,448,963 | B2 | 11/2008 | Beach et al. |
| 7,452,285 | B2 | 11/2008 | Bing-Ling et al. |
| 7,513,296 | B1 | 4/2009 | Yu et al. |
| 7,530,904 | B2 | 5/2009 | Beach et al. |
| 7,540,811 | B2 | 6/2009 | Beach et al. |
| 7,568,985 | B2 | 8/2009 | Beach et al. |
| 7,578,753 | B2 | 8/2009 | Beach et al. |
| 7,591,738 | B2 | 9/2009 | Beach et al. |
| 7,621,823 | B2 | 11/2009 | Beach et al. |
| 7,628,707 | B2 | 12/2009 | Beach et al. |
| 7,632,194 | B2 | 12/2009 | Beach et al. |
| 7,713,142 | B2 | 5/2010 | Hoffman et al. |
| 7,717,804 | B2 | 5/2010 | Beach et al. |
| 7,717,805 | B2 | 5/2010 | Beach et al. |
| 7,744,484 | B1 | 6/2010 | Bing-Ling et al. |
| 7,775,905 | B2 | 8/2010 | Beach et al. |
| 7,846,041 | B2 | 12/2010 | Beach et al. |
| 7,874,936 | B2 | 1/2011 | Chao et al. |
| 7,874,937 | B2 | 1/2011 | Chao et al. |
| 7,963,861 | B2 | 6/2011 | Beach et al. |
| RE42,544 | E | 7/2011 | Chao et al. |
| 7,985,146 | B2 | 7/2011 | Lin et al. |
| 8,025,587 | B2 | 9/2011 | Beach et al. |
| 8,096,897 | B2 | 1/2012 | Beach et al. |
| 8,235,831 | B2 | 8/2012 | Beach et al. |
| 8,235,844 | B2 | 8/2012 | Albertsen et al. |
| 8,241,143 | B2 | 8/2012 | Albertsen et al. |
| 8,241,144 | B2 | 8/2012 | Albertsen et al. |
| 8,303,431 | B2 | 11/2012 | Beach et al. |
| 8,337,319 | B2 | 12/2012 | Sargent et al. |
| 8,444,505 | B2 | 5/2013 | Beach et al. |
| 8,628,434 | B2 | 1/2014 | Chao et al. |
| 8,734,271 | B2 | 5/2014 | Beach et al. |
| 8,870,678 | B2 | 10/2014 | Beach et al. |
| 8,888,607 | B2 | 11/2014 | Harbert et al. |
| 8,900,069 | B2 | 12/2014 | Beach et al. |
| 9,033,821 | B2 | 5/2015 | Beach et al. |
| 9,174,096 | B2 | 11/2015 | Sargent et al. |
| 9,220,953 | B2 | 12/2015 | Beach et al. |
| 9,259,625 | B2 | 2/2016 | Sargent et al. |
| 9,662,545 | B2 | 5/2017 | Beach et al. |
| 10,046,212 | B2 | 8/2018 | Sargent et al. |
| 2004/0106466 | A1 | 6/2004 | Wieland et al. |
| 2004/0229714 | A1 | 11/2004 | Wahl et al. |
| 2005/0239575 | A1 | 10/2005 | Chao et al. |
| 2007/0287554 | A1 | 12/2007 | Gilbert et al. |
| 2008/0149267 | A1 | 6/2008 | Chao et al. |
| 2009/0163289 | A1 | 6/2009 | Chao et al. |
| 2011/0152000 | A1 | 6/2011 | Sargent et al. |
| 2011/0312437 | A1 | 12/2011 | Sargent et al. |
| 2012/0071264 | A1 | 3/2012 | Beach et al. |
| 2012/0122601 | A1 | 5/2012 | Beach et al. |
| 2012/0258818 | A1 | 10/2012 | Beach et al. |
| 2013/0123040 | A1 | 5/2013 | Willett et al. |
| 2013/0217514 | A1 | 8/2013 | Sugimoto |
| 2016/0175666 | A1 | 6/2016 | Chao et al. |
| 2020/0147677 | A1 | 5/2020 | Yu et al. |

| | Cluster 1 | Cluster 2 | Cluster 3 | Cluster 4 | Cluster 5 | Cluster 6 |
|---|---|---|---|---|---|---|
| Degree of complexity of cluster | 1 | 3 | 2 | 2 | 2 | 5 |
| R max (m) | 0.15 | 0.38 | 0.42 | 0.42 | 0.42 | 0.6 |
| R min (m) | NA | 0.28 | 0.24 | 0.24 | 0.24 | 0.3 |
| Major runner cross section | 21 mm, 23 mm | 22 mm, 30 mm | 22 mm, 22 mm | 26 mm | 33 mm, 33 mm | 20 mm, 45 mm |
| Main gate cross section | 22 mm, 21 mm | 23 mm, 20 mm | 23 mm, 20 mm | 23 mm, 20 mm | 23 mm, 20 mm | 22 mm, 30 mm |
| Runner cross sectional area ($m^2$) | 0.000483 | 0.00066 | 0.000209 | 0.000616 | 0.000471 | 0.0009 |
| Wet perimeter (m) | 0.088 | 0.104 | 0.066 | 0.067962 | 0.999000 | 0.13 |
| Gate cross sectional area ($m^2$)[02] | 0.000462 | 0.00092 | 0.00092 | 0.00092 | 0.00092 | 0.00132 |
| Interface getting ratio (%) runner-to-gate[03] | 104.55% | 71.74% | 22.72% | 86.93% | 51.24% | 68.16% |
| R (flow radius) of runner (m) | 0.0054 | 0.0063 | 0.0032 | 0.0070 | 0.0048 | 0.0059 |
| Sharp turn | 1 | 2 | 2 | 2 | 2 | 3 |
| Rotation (mm) | 505 | 370 | 380 | 380 | 380 | 340 |
| Shell preheat temp($^0$C) | 900 | 750 | 750 | 750 | 750 | 500 |
| Angular speed ω (rad/sec) | 52.88 | 36.75 | 39.79 | 39.79 | 35.79 | 35.60 |
| Pouring material (kg) | 9.3 | 39.2 | 35 | 32 | 32 | 72.2 |
| Casting pieces | 14 | 48 | 48 | 48 | 48 | 96 |
| Process loss(kg) | 3.9 | 6 | 7.5 | 7.5 | 7.5 | 10 |

FIG. 5A

| | Cluster 1 | Cluster 2 | Cluster 3 | Cluster 4 | Cluster 5 | Cluster 6 |
|---|---|---|---|---|---|---|
| Actual available filling material (kg) | 5.4 | 33.2 | 27.5 | 24.5 | 24.5 | 62.2 |
| Material usage (kg/pc) (w/o process loss) | 0.664 | 0.817 | 0.729 | 0.667 | 0.667 | 0.752 |
| Material usage (kg/pc) (w/ process loss) | 0.386 | 0.692 | 0.573 | 0.510 | 0.510 | 0.648 |
| Process loss ratio | 41.9% | 15.3% | 21.4% | 23.4% | 23.4% | 13.9% |
| Velocity max (m/s) | 7.93 | 14.72 | 16.71 | 16.71 | 16.71 | 14.24 |
| Velocity min (m/s) | NA | 10.85 | 9.55 | 9.55 | 9.55 | 9.61 |
| Acceleration max ($m/s^2$) | 419.47 | 570.45 | 665.04 | 655.04 | 665.04 | 507.05 |
| Acceleration min ($m/s^3$) | NA | 420.33 | 380.02 | 380.02 | 380.02 | 342.26 |
| Force max (N1) | 161.80 | 394.56 | 381.01 | 339.45 | 339.45 | 328.53 |
| Force min (N1) | NA | 290.73 | 217.72 | 193.97 | 193.97 | 221.75 |
| Pressure max (Pa) | 334984.13 | 597821.56 | 1823027.72 | 551289.62 | 720076.71 | 365027.92 |
| Pressure min (Pa) | NA | 316010.94 | 236653.91 | 210837.12 | 210637.12 | 157995.81 |
| Kinetic energy max (J) | 12.13 | 74.97 | 80.01 | 71.28 | 71.23 | 65.71 |
| Density (MP) ($g/cm^2$) | 4.11 | 4.11 | 4.11 | 4.11 | 4.11 | 4.11 |
| Viscosity (MP) ($g/cm^2sec$) | 0.033 | 0.033 | 0.033 | 0.033 | 0.033 | 0.033 |
| Renumber max | 212075.72 | 455478.47 | 263556.77 | 582820.22 | 395456.52 | 491181.21 |
| Renumber min | NA | 342884.14 | 150681.01 | 333040.13 | 226548.68 | 331547.32 |
| Casting yield | 94% | 93% | 78% | 94% | 94% | 89% |

FIG. 5B

CLUSTER FOR AND METHOD OF CASTING GOLF CLUB HEADS

FIELD

This disclosure relates generally to golf club heads of golf clubs, and more particularly to casting clusters and corresponding processes for manufacturing golf club heads.

BACKGROUND

Modern "wood-type" golf clubs (notably, "drivers," "fairway woods," and "utility or hybrid clubs"), are generally called "metalwoods" since they tend to be made of strong, lightweight metals, such as titanium. An exemplary metalwood golf club, such as a driver or fairway wood, typically includes a hollow shaft and a golf club head coupled to a lower end of the shaft. Most modern versions of club heads are made, at least in part, from a lightweight but strong metal, such as a titanium alloy. In most cases, the golf club head is includes a hollow body with a face portion. The face portion has a front surface, known as a strike face, configured to contact the golf ball during a proper golf swing.

The current ability to make golf club heads of strong, lightweight materials has allowed the walls of the golf club heads to be made thinner. Generally, some golf club heads are made by urging molten material into a mold cavity in a process commonly called casting. Casting facilitates the manufacture of golf club heads with thin walls. However, forming thinner walls using casting techniques requires a correspondingly narrower mold cavity, which requires a correspondingly greater force to urge the molten material fully and completely into the mold cavity. These, and other considerations, make casting golf club heads, at a high yield and low material usage, difficult.

SUMMARY

The subject matter of the present application has been developed in response to the present state of the art, and in particular, in response to the shortcomings of casting techniques for golf club heads that have not yet been fully solved by currently available techniques. Accordingly, the subject matter of the present application has been developed to provide a cluster and corresponding casting technique that overcome at least some of the above-discussed shortcomings of prior art techniques.

Disclosed herein is a casting cluster for casting a body of a golf club head made of titanium or a titanium alloy. The casting cluster comprises a receptor and a plurality of runners coupled to the receptor and configured to receive molten metal from the receptor. The casting cluster also includes at least twenty-eight main gates. At least two of the main gates are coupled to each of the runners and each main gate is configured to receive molten metal from a corresponding one of the plurality of runners. The casting cluster further comprises at least twenty-eight molds. At least two of the at least twenty-eight molds are coupled to each one of the plurality of runners via respective main gates of the at least twenty-eight main gates. Each mold of the at least twenty-eight molds is configured to receive molten metal from a corresponding one of the main gates. Each mold of the at least twenty-eight molds is configured to cast a body of a golf club head that has a volume of at least 100 cm3. The preceding subject matter of this paragraph characterizes example 1 of the present disclosure.

The plurality of runners comprises at least fourteen runners. The preceding subject matter of this paragraph characterizes example 2 of the present disclosure, wherein example 2 also includes the subject matter according to example 1, above.

Each runner of the plurality of runners comprises a proximal end, adjacent the receptor, and a distal end, opposite the proximal end. One main gate and one mold are coupled to the distal end of each of the plurality of runners. At least one main gate and at least one mold are coupled to each of the plurality of runners between the proximal end and the distal end of the corresponding runner. The preceding subject matter of this paragraph characterizes example 3 of the present disclosure, wherein example 3 also includes the subject matter according to any one of examples 1-2, above.

Each runner of the plurality of runners comprises a top surface and a bottom surface, opposite the top surface. The at least one main gate and the at least one mold coupled to each of the plurality of runners between the proximal end and the distal end are coupled to the bottom surface of the corresponding runner. The preceding subject matter of this paragraph characterizes example 4 of the present disclosure, wherein example 4 also includes the subject matter according to example 3, above.

At least two main gates and at least two molds are coupled to each of the plurality of runners between the proximal end and the distal end of the corresponding runner. One of the at least two main gates and one of the at least two molds are coupled to the bottom surface of the corresponding runner. Another one of the at least two main gates and another one of the at least two molds are coupled to the top surface of the corresponding runner. The preceding subject matter of this paragraph characterizes example 5 of the present disclosure, wherein example 5 also includes the subject matter according to example 4, above.

Each runner of the plurality of runners comprises a top surface and a bottom surface, opposite the top surface. The at least one main gate and the at least one mold coupled to each of the plurality of runners at the location between the proximal end and the distal end are coupled to the top surface of the corresponding runner. The preceding subject matter of this paragraph characterizes example 6 of the present disclosure, wherein example 6 also includes the subject matter according to any one of examples 3-5, above.

Each runner of the plurality of runners comprises a proximal end, adjacent the receptor, and a distal end, opposite the proximal end. At least two main gates and at least two molds are coupled to each of the plurality of runners between the proximal end and the distal end of the corresponding runner. The preceding subject matter of this paragraph characterizes example 7 of the present disclosure, wherein example 7 also includes the subject matter according to any one of examples 1-6, above.

Each runner of the plurality of runners comprises a top surface and a bottom surface, opposite the top surface. One of the at least two main gates and one of the at least two molds are coupled to the bottom surface of the corresponding runner. Another one of the at least two main gates and another one of the at least two molds are coupled to the top surface of the corresponding runner. The preceding subject matter of this paragraph characterizes example 8 of the present disclosure, wherein example 8 also includes the subject matter according to example 7, above.

Each runner of the plurality of runners comprises a top surface and a bottom surface, opposite the top surface. The at least two main gates and the at least two molds are coupled to the bottom surface of the corresponding runner. The preceding subject matter of this paragraph characterizes example 9 of the present disclosure, wherein example 9 also includes the subject matter according to any one of examples 7-8, above.

Each runner of the plurality of runners comprises a top surface and a bottom surface, opposite the top surface. The at least two main gates and the at least two molds are coupled to the top surface of the corresponding runner. The preceding subject matter of this paragraph characterizes example 10 of the present disclosure, wherein example 10 also includes the subject matter according to any one of examples 7-9, above.

One mold coupled to each of the plurality of runners is configured to cast a body having a first size or a first shape. Another mold coupled to each of the plurality of runners is configured to cast a body having a second size, different than the first size, or a second shape, different than the first shape. The preceding subject matter of this paragraph characterizes example 11 of the present disclosure, wherein example 11 also includes the subject matter according to any one of examples 1-10, above.

The body, having the first size, corresponds with the body of a driver-type golf club head. The body, having the second size, corresponds with the body of a fairway-type golf club head. The preceding subject matter of this paragraph characterizes example 12 of the present disclosure, wherein example 12 also includes the subject matter according to example 11, above.

At least three of the main gates are coupled to each of the runners. The preceding subject matter of this paragraph characterizes example 13 of the present disclosure, wherein example 13 also includes the subject matter according to any one of examples 1-12, above.

Each mold of the at least twenty-eight molds is configured to cast a body of a golf club head that has a volume of no more than 250 cm3. The preceding subject matter of this paragraph characterizes example 14 of the present disclosure, wherein example 14 also includes the subject matter according to any one of examples 1-13, above.

Each mold of the at least twenty-eight molds is configured to cast a body of a golf club head that has a volume of at least 420 cm3. The preceding subject matter of this paragraph characterizes example 15 of the present disclosure, wherein example 15 also includes the subject matter according to any one of examples 1-13, above.

Each mold of the at least twenty-eight molds is configured to cast a body, of a golf club head, having at least a portion with a wall thickness of at most 0.6 mm. The preceding subject matter of this paragraph characterizes example 16 of the present disclosure, wherein example 16 also includes the subject matter according to any one of examples 1-15, above.

Each mold of the at least twenty-eight molds is configured to cast a body, of a golf club head, having a portion with a wall thickness of at most 0.8 mm. The preceding subject matter of this paragraph characterizes example 17 of the present disclosure, wherein example 17 also includes the subject matter according to any one of examples 1-15, above.

The casting cluster is configured to produce a cast-product yield of at least 80%. The preceding subject matter of this paragraph characterizes example 18 of the present disclosure, wherein example 18 also includes the subject matter according to any one of examples 1-17, above.

Each of the at least twenty-eight main gates and the corresponding runner, to which each of the at least twenty-eight main gates are coupled, have an interface gating ratio between 0.7 and 1.3. The preceding subject matter of this paragraph characterizes example 19 of the present disclosure, wherein example 19 also includes the subject matter according to any one of examples 1-18, above.

The body of the golf club head, cast by each mold, comprises a crown opening and an entirety of a face portion of the golf club head. The preceding subject matter of this paragraph characterizes example 20 of the present disclosure, wherein example 20 also includes the subject matter according to any one of examples 1-19, above.

The body of the golf club head, cast by each mold, comprises an entirety of a crown portion of the golf club head and a face opening in a face portion of the golf club head. The preceding subject matter of this paragraph characterizes example 21 of the present disclosure, wherein example 21 also includes the subject matter according to any one of examples 1-19, above.

The body of the golf club head, cast by each mold, comprises a sole opening and an entirety of a face portion of the golf club head. The preceding subject matter of this paragraph characterizes example 22 of the present disclosure, wherein example 22 also includes the subject matter according to any one of examples 1-20, above.

Also disclosed herein is a method of casting a body of a golf club head made of titanium or a titanium alloy. The method comprises rotating a casting cluster at a rotational speed of at least 550 rotations-per-minute (RPM). The casting cluster comprises a receptor and a plurality of runners coupled to the receptor and configured to receive molten metal from the receptor. The casting cluster also comprises at least twenty-eight main gates. At least two of the main gates are coupled to each of the runners and each main gate is configured to receive molten metal from a corresponding one of the plurality of runners. The casting cluster further comprises at least twenty-eight molds. At least two of the at least twenty-eight molds are coupled to each one of the plurality of runners via respective main gates of the at least twenty-eight main gates. Each mold of the at least twenty-eight molds is configured to receive molten metal from a corresponding one of the main gates. Each mold of the at least twenty-eight molds is configured to cast a body of a golf club head that has a volume of at least 100 cm3. While rotating the casting cluster, the method comprises introducing a molten titanium-based metal into a casting cluster. While rotating the casting cluster, the method comprises flowing the molten titanium-based metal through the plurality of runners, through the at least twenty-eight main gates, and into the at least twenty-eight molds. The method additionally comprises producing a cast-product yield of at least 80%. The preceding subject matter of this paragraph characterizes example 23 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which:

FIG. 5A is a table of casting data obtained from six different casting clusters, according to one or more examples of the present disclosure;

FIG. 5B is another table of casting data obtained from six different casting clusters, according to one or more examples of the present disclosure;

DETAILED DESCRIPTION

The following describes embodiments of golf club heads in the context of golf club heads for drivers, fairway woods, and utility clubs (also known as hybrid clubs). However, concepts described herein may also be applicable to iron-type golf club heads unless otherwise indicated.

Figure 1:
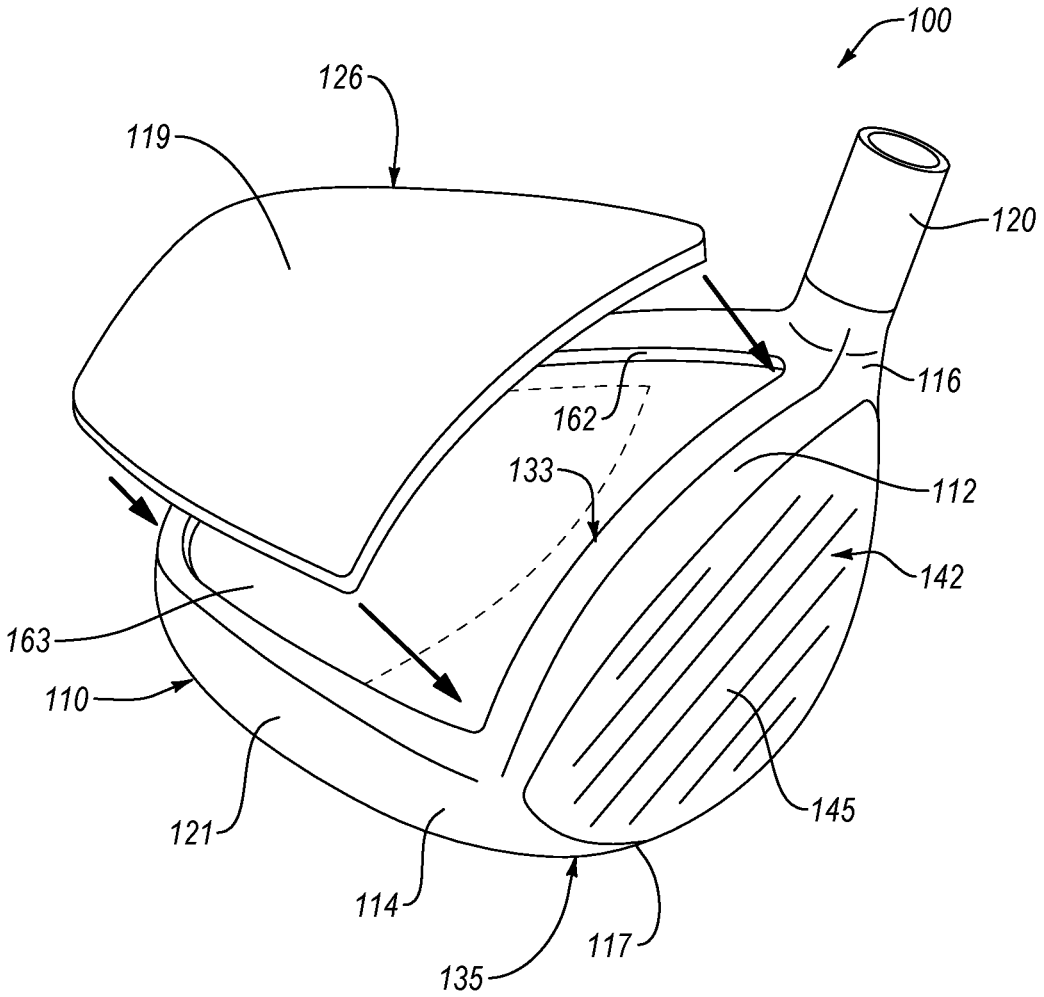
FIG. 1 is a perspective view of a golf club head, according to one or more examples of the present disclosure.
Figure 2:
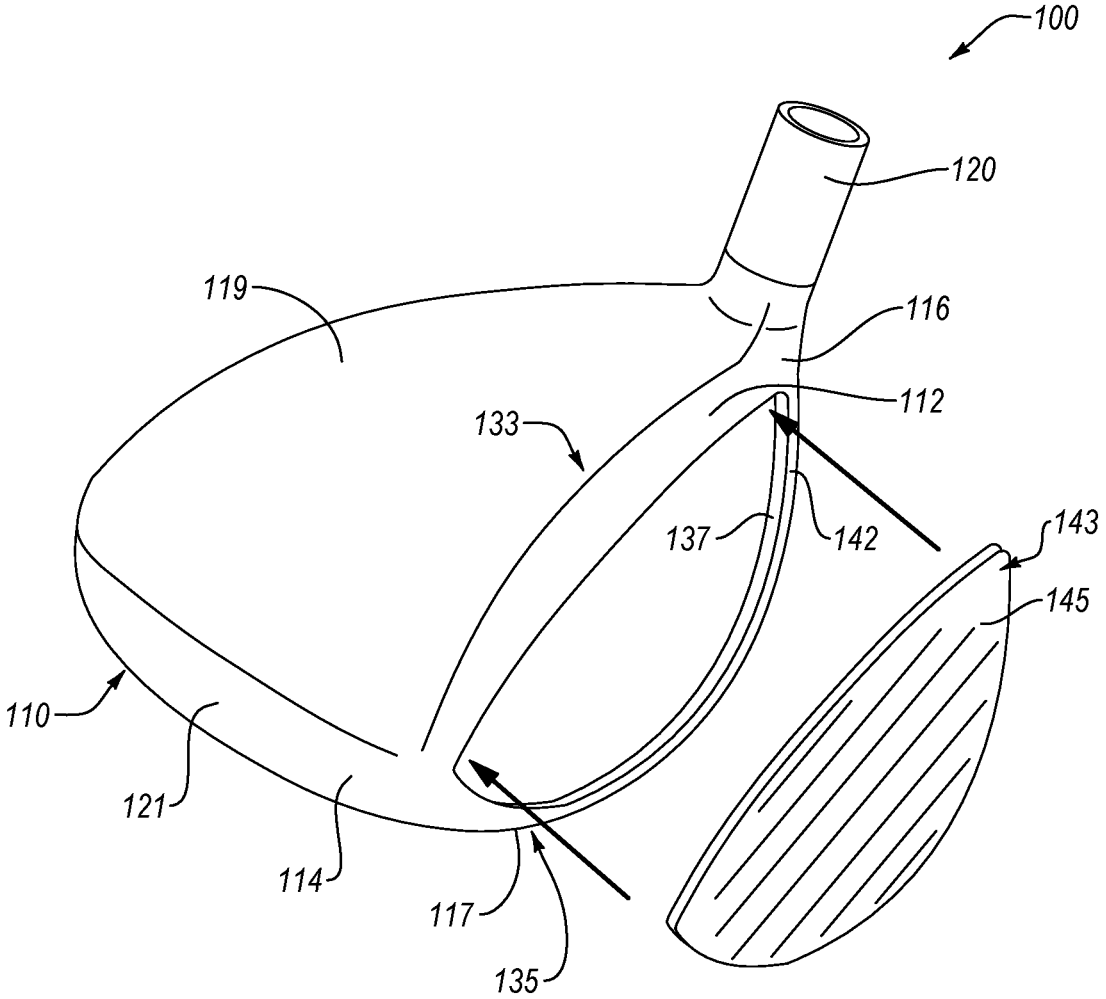
FIG. 2 is an exploded perspective view of a golf club head, with a crown insert and a strike plate, according to one or more examples of the present disclosure.

Referring to FIGS. 1 and 2, the golf club head 100 of the present disclosure includes a body 110. The golf club head 100 has a toe region 114 and a heel region 116, opposite the toe region 114, defined by the body 110. Additionally, the golf club head 100 includes a forward region 112 and a rearward region 118, opposite the forward region 112, also defined by the body 110. The golf club head 100 further includes a face portion 142 at the forward region 112 of the golf club head 100. The face portion 142 can be partially (see, e.g., FIG. 2) or entirely (see, e.g., FIG. 1) defined by the body 110. The golf club head 100 additionally includes a sole portion 117, defined partially or entirely by the body 110, at a bottom region 135 of the golf club head 100, and a crown portion 119, defined partially (see, e.g., FIG. 1) or entirely (see, e.g., FIG. 2) by the body 110, opposite the sole portion 117 and at a top region 133 of the golf club head 100. Also, the golf club head 100 includes a skirt portion 121, defined by the body 110, that defines a transition region where the golf club head 100 transitions between the crown portion 119 and the sole portion 117. Accordingly, the skirt portion 121 is located between the crown portion 119 and the sole portion 117 and extends about a periphery of the golf club head 100.

The face portion 142 extends along the forward region 112 of the golf club head 100 from the sole portion 117 to the crown portion 119. Moreover, the exterior surface, and at least a portion of the interior surface, of the face portion 142 is planar in a top-to-bottom direction. As further defined, the face portion 142 is the portion of the golf club head 100 at the forward region 112 with an exterior surface that faces in the generally forward direction. An exterior surface of the face portion 142 defines a strike face 145 of the golf club head 100. The strike face 145 is configured to impact and drive the golf ball during a normal swing of the golf club head 100.

In FIG. 1, the body 110 includes a crown opening 162 formed in the top region 133 of the body 110. Accordingly, the body 110 does not have a crown portion 119. Rather, the crown portion 119 is defined by a crown insert 126 that is coupled to the body 110 over the crown opening 162. The crown insert 126 can be coupled to the body 110 in any of various ways, such as bonding and welding. In some examples, the crown insert 126 is made from a material, such as a non-metal material, that is different than the material of the body 110. However, in other examples, the crown insert 126 is made from a material that is the same as the material of the body 110. For example, the crown insert 126 and the body 110 can be made of a titanium-based material.

In FIG. 2, the face portion 142 of the body 110 of the golf club head 100 of FIG. 2 includes a face opening 137 that is configured to receive a strike plate 143. The face portion 142 may include a lip (not shown) peripherally surrounding the face opening 135 to help facilitate coupling of the strike plate 143 to the body 110 over the opening 137. The exterior surface of the strike plate 143 defines at least a portion of the strike face 145 of the face portion 142. The strike plate 143 can be coupled to the face portion 142 over the face opening 137 in various ways, such as bonding and welding. Moreover, the strike plate 143 can be made of the same material as that of the body 110 or a material different than that of the body 110.

The body 110 of the golf club head 100 of FIGS. 1 and 2 has a single, one-piece, monolithic construction. Accordingly, all portions of the golf club head 100 of FIGS. 1 and 2 defined by the body 110 are co-formed together such that the all portions of the golf club head 100 are continuously and seamlessly coupled together. For example, all portions of the golf club head 100 of FIG. 1 defined by the body 110, including the entirety of the face portion 142, are co-cast together using a casting process, such as one described herein. As another example, all portion of the golf club head 100 of FIG. 2 defined by the body 110, including the crown portion 119, but not the entirety of the face portion 142, are co-cast together using a casting process, such as one described herein.

Although not shown, the golf club head 100 may include other portions that are separately formed and coupled to a monolithically-constructed body. Such other portions can be in addition to or instead of the crown insert 126 and the strike face 143. For example, the golf club head 100 may include a sole insert, that when coupled to the body 110 over a sole opening (e.g., sole opening 163 in FIG. 1) in the body 110, defines at least a portion of the sole portion 117 of the golf club head 100. The sole insert can be made of a material, such as a non-metal, that is different than the material of the body 110 or a metal, that is the same as the material of the body 110.

The golf club head 100 also includes a hosel 120 extending from the heel region 116 of the golf club head 100. Although not shown, a shaft of a golf club is attached directly to the hosel 120 or, alternatively, attached indirectly to the hosel 120, such as via a flight control technology (FCT) component (e.g., an adjustable lie/loft assembly) coupled with the hosel 120. A grip may be fitted around a distal end or free end of the shaft to complete the golf club. The grip of the golf club helps promote the handling of the golf club by a user during a golf swing.

The golf club head 100 can include any of various coefficient of restitution (COR) enhancing features, such as slots, formed in the body 110 of the golf club head 100. For example, the body 110 may include a slot formed in the body 110 at the sole portion 117 of the golf club head 100. The slot is a groove or channel in some examples. Moreover, the slot can be a through-slot, or a slot that is open on a sole portion side of the slot and open on an interior cavity side or interior side of the slot. However, in other implementations, the slot is not a through-slot, but rather is closed on an interior cavity side or interior side of the slot. The slot can be any of various flexible boundary structures (FBS), such as those described in U.S. Pat. No. 9,044,653, filed Mar. 14, 2013, which is incorporated by reference herein in its entirety. Additionally, or alternatively, the body 110 of the golf club head 100 can include one or more other FBS at any of various other locations on the golf club head 100. In some implementations, the slot is filled with a filler material. The filler material can be made from a non-metal, such as a thermoplastic material, thermoset material, and the like, in some implementations. However, in other implementations, the slot is not filled with a filler material, but rather maintains an open, vacant, space within the slot. The slot functions as a weight track for adjustably retaining at least one weight within the slot. Further details concerning the slot as a COR feature of the golf club head 100 can be found in U.S. patent application Ser. Nos. 13/338,197, 13/469,031, 13/828,675, filed Dec. 27, 2011, May 10, 2012, and Mar. 14, 2013, respectively, U.S. patent application Ser. No. 13/839,727, filed Mar. 15, 2013, U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

Although not shown, the body 110 of the golf club head 100 may include any of various ribs or stiffeners on an interior surface of the body 110 and monolithically formed or co-cast with the body 110. Furthermore, although not specifically shown, the golf club head 100 of the present disclosure may include other features to promote the performance characteristics of the golf club head 100. For example, the golf club head 100, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety. In certain implementations, for example, the golf club head 100 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety. According to some implementations, the golf club head 100 includes aerodynamic shape features similar to those described in more detail in U.S. Patent Application Publication No. 2013/0123040A1, the entire contents of which are incorporated herein by reference in their entirety. In certain implementations, the golf club head 100 includes removable shaft features similar to those described in more detail in U.S. Pat. No. 8,303,431, the contents of which are incorporated by reference herein in in their entirety. According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety. Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety. In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

All portions of the body 110, being monolithic, are made of the same material, which can be titanium or any of various titanium-based alloys. In some examples, the body 110 is made of a titanium alloy, including, but not limited to, 9-1-1 titanium, 6-4 titanium, 3-2.5, 6-4, SP700, 15-3-3-3, 10-2-3, or other alpha/near alpha, alpha-beta, and beta/near beta titanium alloys) or mixtures thereof. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation.

Golf club head bodies that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club head bodies comprising an integrally cast 9-1-1 Ti face, the drawback of having to remove the alpha case can be eliminated, or at least substantially reduced. For a cast 9-1-1 Ti face, using a conventional mold pre-heat temperature of 1000 C or more, the thickness of the alpha case can be about 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.15 mm, or greater than 0.20 mm, or greater than 0.30 mm, such as from about 0.25 mm to about 0.30 mm in some examples.

In some cases, the reduced thickness of the alpha case for 9-1-1 Ti face portions (e.g., 0.15 mm or less) may not be thin enough to provide sufficient durability needed for a face portion and to avoid needing to etch away some of the alpha case with a harsh chemical etchant, such as HF acid. In such cases, the pre-heat temperature of the mold can be lowered (such as to less than 800 C, less than 700 C, less than 600 C, and/or less than or equal to 500 C) prior to pouring the molten titanium alloy into the mold. This can further reduce the amount of oxygen transferred from the mold to the cast titanium alloy, resulting in a thinner alpha case (e.g., less than 0.15 mm, less than 0.10 mm, and/or less than 0.07 mm). This provides better ductility and durability for the body with integral face, which is especially important for the face portion.

The thinner alpha case in cast 9-1-1 Ti faces helps provide enhanced durability, such that the face is durable enough that the removal of part of the alpha case from the face via chemical etching is not needed. Thus, hydrofluoric acid etching can be eliminated from the manufacturing process when the body and face are unitarily cast using 9-1-1 Ti, especially when using molds with lower pre-heat temperatures. This can simplify the manufacturing process, reduce cost, reduce safety risks and operation hazards, and eliminate the possibility of environmental contamination by HF acid. Further, because HF acid is not introduced to the metal, the body with integral face, or even the whole club head, can comprise very little or substantially no fluorine atoms, which can be defined as less than 1000 ppm, less than 500 ppm, less than 200 ppm, and or less than 100 ppm, wherein the fluorine atoms present are due to impurities in the metal material used to cast the body.

In some examples, the body 110 is made of an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy). In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative embodiment, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape (e.g., bulge and roll) and have a lower tendency to flatten over time.

The golf club head 100 disclosed herein may have a volume equal to the volumetric displacement of the body 110 of the golf club head 100. The volumetric displacement of the body 110 is determined under the assumption that all openings into the interior of the body 110, such as those formed for receiving inserts or a strike plate and those defined by a slot or port, are covered. According to some examples, the golf club head 100 of the present application can be configured to have a head volume between about 110 cm$^3$ and about 600 cm$^3$. In more particular examples, the head volume may be between about 250 cm$^3$ and about 500 cm$^3$. In yet more specific examples, the head volume may be between about 300 cm$^3$ and about 500 cm$^3$, between about 300 cm$^3$ and about 360 cm$^3$, between about 300 cm$^3$ and about 420 cm$^3$ or between about 420 cm$^3$ and about 500 cm$^3$.

In the case of a driver, the golf club head 100 may have a volume between about 300 $cm^3$ and about 460 $cm^3$, and a total mass between about 145 g and about 245 g. In the case of a fairway wood, the golf club head 100 may have a volume between about 100 $cm^3$ and about 250 $cm^3$, and a total mass between about 145 g and about 260 g. In the case of a utility or hybrid club the golf club head 100 may have a volume between about 60 $cm^3$ and about 150 $cm^3$, and a total mass between about 145 g and about 280 g.

In some examples, the golf club head 100 is a driver-type golf club head with the strike face 145 having a relatively large area, such as at least 3500 mm^2, preferably at least 3800 mm^2, and even more preferably at least 3900 mm^2. Additionally, the golf club head 100 in these examples may include a center of gravity (CG) projection, along a horizontal plane with the golf club head 100 in a proper address position, that may be at most 3 mm above or below a center of the strike face 145 (i.e., center face), and preferably may be at most 1 mm above or below center face as measured along a vertical axis (z-axis). Moreover, the golf club head 100 in these examples may have a relatively high volume, i.e., 400 cc to 500 cc, and a relatively high moment of inertia about a vertical z-axis (e.g. Izz), such as greater than 350 kg-mm^2 and preferably greater than 400 kg-mm^2, a relatively high moment of inertia about a horizontal x-axis (e.g. Ixx), such as greater than 200 kg-mm^2 and preferably greater than 250 kg-mm^2, and may have a ratio of Ixx/Izz that is at least 0.55. The vertical z-axis and the horizontal x-axis, for purposes of Ixx and Izz, is the head center-of-gravity x-axis and the head center-of-gravity z-axis, as opposed to the head origin x-axis and the head origin z-axis.

In other examples, the golf club head 100 is a fairway-type golf club head having a relatively smaller volume, i.e., 100 cc to 200 cc, and with the strike face 145 having a relatively smaller area, such as between 1,500 mm^2 and 3,000 mm^2 and/or at most 3,500 mm^2. Moreover, the golf club head 100, in other examples, has a moment of inertia about the vertical z-axis (Izz) that is less than 400 kg-mm^2 and greater than 150 kg-mm^2, a moment of inertia about the horizontal x-axis (Ixx) that is less than 300 kg-mm^2 and greater than 90 kg-mm^2, and a ratio Ixx/Izz that is at least 0.35.

Figure 3:
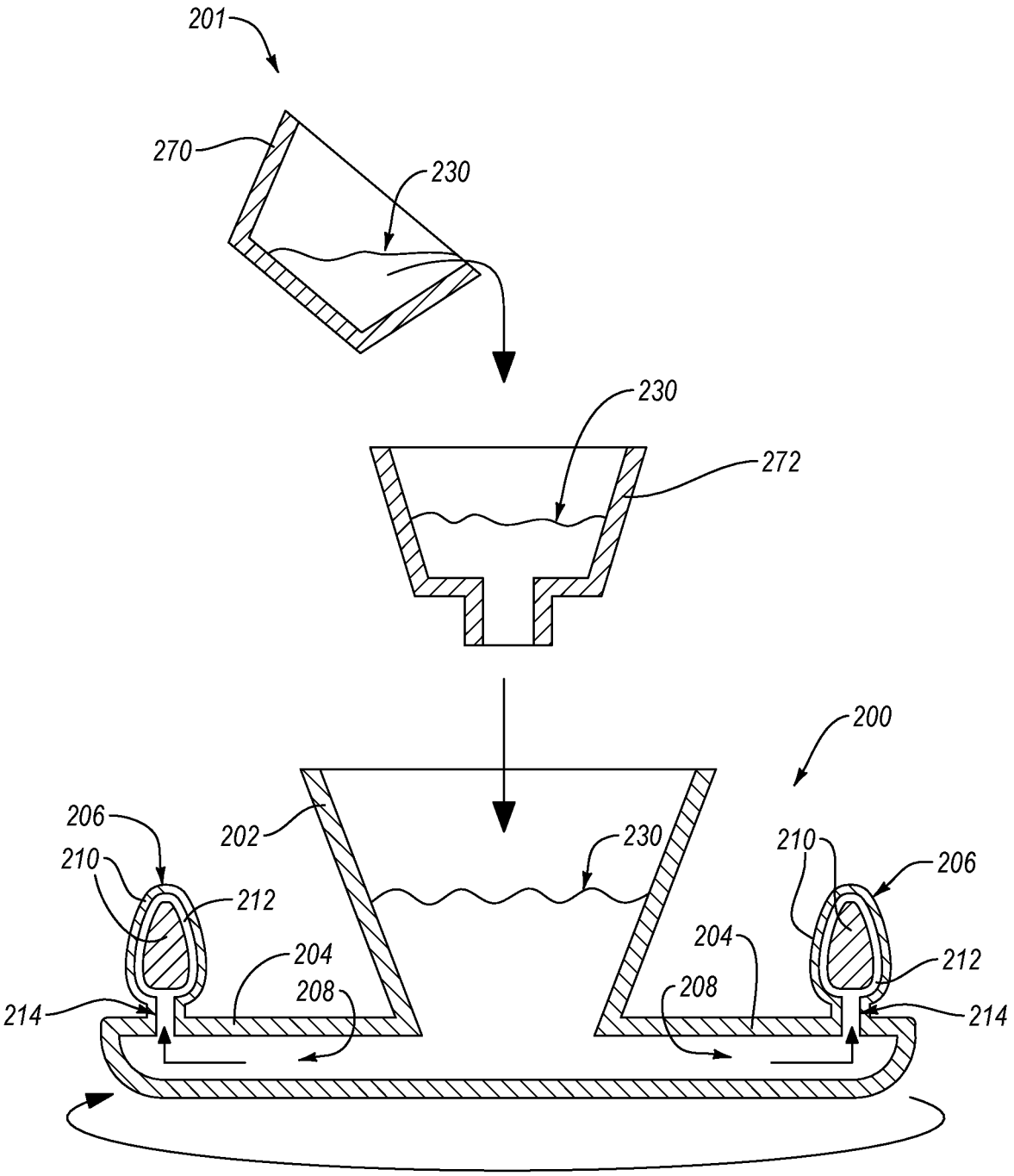
FIG. 3 is a cross-sectional side view of a casting system, including a casting cluster, according to one or more examples of the present disclosure.

The body 110 of the golf club head 100 is formed by a casting method 400 configured to make multiple bodies 110 out of a titanium-alloy at the same time. The multiple bodies 110 correspond with multiple golf club heads 100. In one example, the casting method 400 is configured to produce at least 28 bodies 110 at one time. The casting method 400 is patterned generally after some features of so-called investment casting. Accordingly, each body 110 is formed from a corresponding cast of a plurality of casts of a casting cluster. Referring to FIG. 3, one example of a casting cluster 200, which forms part of a casting system 201, includes a plurality of molds 206 each in material receiving communication with a corresponding one of a plurality of runners 204. Each of the molds 206 includes a shell 210 that defines a mold cavity 212.

Figure 4:
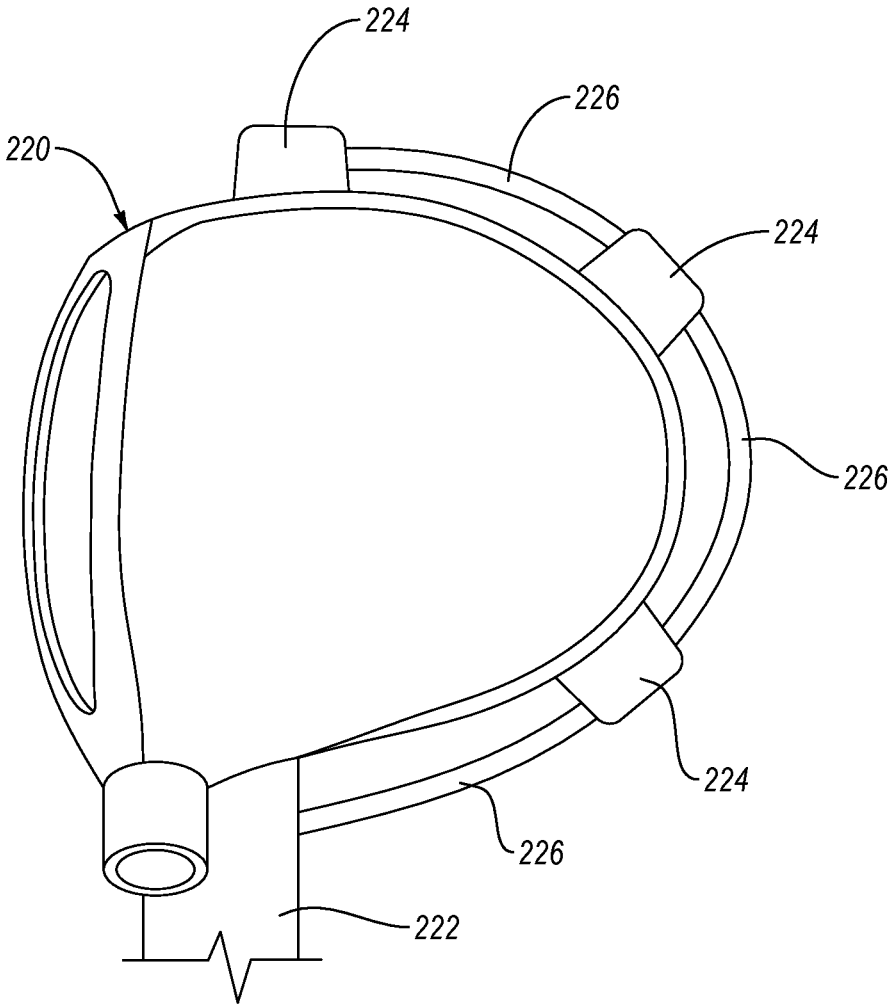
FIG. 4 is a top plan view of an initial pattern of casting wax, according to one or more examples of the present disclosure.

The casting method 400 includes forming the casting cluster 200 at 402. The sub-process for forming each of the molds 206 of the casting cluster 200 will now be described. Injection molding is used to form sacrificial "initial" patterns (made of casting "wax") of the desired castings. One example of an initial pattern 220 is shown in FIG. 4. The initial pattern 220, made of wax, replicates the desired design of the body 110, to be made of titanium or a titanium-alloy, to be cast using the casting method 400. A suitable injection die can be made of aluminum or other suitable alloy or other material by a computer-controlled machining process using a casting master. CNC (computer numerical control) machining desirably is used to form the intricacies of the mold cavity 212 in the die. The dimensions of the die are established so as to compensate for linear and volumetric shrinkage of the casting wax encountered during casting of the initial pattern 220 and also to compensate for any similar shrinkage phenomena expected to be encountered during actual metal casting performed later using the molds 206.

A group of initial patterns 220 of casting wax is assembled together and attached to a central wax sprue to form a wax "cluster" of initial patterns. Each initial pattern 220 in the wax cluster will be used to form a respective one of the molds 206, which are formed later around the initial patterns 220. The central wax sprue defines the locations and configurations of runner channels 208 and main gates 214 of the casting cluster 200, which are used for routing molten metal to the molds 206.

The shells 210 of the molds 206 are constructed by immersing the wax cluster into a liquid ceramic slurry, followed by immersion into a bed of refractory particles. This immersion sequence is repeated as required to build up a sufficient wall thickness of ceramic material around the wax cluster, including the initial patterns, thereby forming the shells 210, which can be described as investment-casting shells. An exemplary immersion sequence includes six dips of the wax cluster in liquid ceramic slurry and five dips in the bed of refractory particles, yielding an investment-casting shell comprising alternating layers of ceramic and refractory material. In one example, the first two layers of refractory material comprise fine (e.g., 300 mesh) zirconium oxide particles, and the third to fifth layers of refractory material can comprise coarser (e.g., 200 mesh to 35 mesh) aluminum oxide particles. Each layer is dried under a controlled temperature (e.g., 25±5° C.) and relative humidity (e.g., 50±5%) before applying the subsequent layer.

The investment-casting shell is placed in a sealed steam autoclave in which the pressure is rapidly increased, such as to 7-10 $kg/cm^2$. Under such conditions, the wax of the initial patterns 220 in the shells 210 is melted out using injected steam thereby forming the mold cavity 212. The mold 206 is then baked in an oven in which the temperature is ramped up to, for example, 1,000° C. to 1,300° C. to remove residual wax and to increase the strength of the shell 210. The mold 206 is now ready for use in investment casting.

The runners 204, including the channels 208 and the main gates 214, of the casting cluster 200 are formed using the same process as that of the molds 206. More specifically, the investment-casting shell is also formed around the runner portions of the wax cluster. After the wax is melted out, the remaining shell defines the runners 204.

An important aspect of configuring the casting cluster 200 is determining the locations at which to place the main gates 214. A mold cavity of a mold for an individual club head usually has one main gate, through which molten metal flows into the mold cavity. Additional auxiliary ("assistant") gates can be connected to the main gate by flow channels. During investment casting using such a mold, the molten metal flows into each of the mold cavities through the respective main gates, through the flow channels, and through the auxiliary gates. Referring to FIG. 4, this manner of flow requires that the die for forming the initial pattern 220 of a club head also define a main gate pattern 222 and any assistant gate patterns 224. After making the wax initial pattern 220 of the club head, the main gate pattern 222, and any assistant gate patterns 224, they are removed from the die, and the locations of flow channels are defined by coupling (e.g., gluing) a flow channel piece 226, made of wax, between adjacent gate patterns 222, 224.

Multiple initial patterns 220, and corresponding main gate pattern 222, assistant gate patterns 224, and flow channel pieces 226, for respective club heads are then assembled into the casting cluster 200, which includes attaching the individual main gates to "ligaments." The ligaments include the sprue and runners of the casting cluster 200. As shown in FIG. 2, a receptor 202, usually made of graphite or the like, is placed at the center of the casting cluster 200, where it later will be used to receive the molten metal and direct the metal to the runners 204. The receptor 202 desirably has a funnel-like configuration to aid entry-flow of molten metal. Additional braces (made of, e.g., graphite) may be added to reinforce the casting cluster 200.

In some examples, the overall wax cluster is sufficiently large (especially if the furnace chamber that will be used for forming the shell is large) to allow pieces of wax to be "glued" to individual branches of the wax cluster first, followed by ceramic coating of the individual branches separately before the branches are assembled together into the casting cluster 200. Then, after assembling together the branches, the casting cluster 200 is transferred to a casting chamber (not shown) to cast the bodies 110.

Referring back to FIG. 2, after the casting cluster 200 is formed and the casting cluster 200 is rotating (as described below), the casting method 400 further includes, at 406, pouring molten metal 230 from a crucible 270 into the receptor 202 of the casting cluster 200 using a pouring cup 272. The pouring cup 272 helps to direct the molten metal 230 into the receptor 202. From the receptor 202, the molten metal 230 is urged, at 408 of the casting method 400, into the runner channels 208 or branches. From the runner channel 208, the molten metal 230 is urged into the mold cavities 212 of the molds 206 via the main gates 214 and any assistant gates.

At 404, the casting method 400 also includes rotating the casting cluster 200 in a centrifugal manner, as indicated by a rotational directional arrow, to harness and exploit the force generated by the $\omega^2 r$ acceleration of the casting cluster 200 undergoing such motion, where $\omega$ is the angular velocity of the casting cluster 200 and r is the radius of the angular motion. According to one example, angular rotation of the casting cluster 200 is performed using a turntable situated inside the casting chamber at a subatmospheric pressure. The force generated by the $\omega^2 r$ acceleration of the casting cluster 200 urges flow of the molten metal 230 into the mold cavities 212 without leaving voids. The casting cluster 200 (including its constituent molds 206 and runners 204) is generally assembled outside the casting chamber and heated to a pre-set temperature before being placed as an integral unit on the turntable in the casting chamber. After mounting the shell to the turntable, the casting chamber is sealed and evacuated to a pre-set subatmospheric-pressure (e.g., vacuum) level. As the chamber is being evacuated, the molten metal 230 is prepared and the turntable commences rotating. When the molten metal 230 is ready for pouring into the casting cluster 200, the casting chamber is at the proper vacuum level, the casting cluster 200 is at a suitable temperature, and the turntable is spinning at the desired angular velocity. Thus, the molten metal 230 is poured into the receptor 202 of the casting cluster 200 and flows throughout the casting cluster 200 to fill the mold cavities 212 of the molds 206.

Configuring the features of the casting cluster 200, including the main gates 214, the runners 204, and the molds 206 involves consideration of multiple factors. These factors include (but are not necessarily limited to): (a) the dimensional limitations of the casting chamber of the metal-casting furnace, (b) handling requirements, particularly during the slurry-dipping steps that form the casting cluster 200, (c) achieving an optimal flow pattern of the molten metal 230 in the casting cluster 200, (d) providing the runners 204, the main gates 214, and the molds 206 of the casting cluster 200 with at least minimum strength required for them to withstand rotational motion during metal casting, (e) achieving a balance of minimum resistance to flow of the molten metal 230 into the mold cavities 212 (by providing the runners 204 and the main gates 214 with sufficiently large cross-sections) versus achieving minimum waste of metal (e.g., by providing the runners 204 with small cross-sections), and (f) achieving a mechanical balance of the casting cluster 200 about a central axis of the casting cluster 200. Factor (e) is important because, after casting, any metal remaining in the runners 204 does not form product, but rather is contaminated or lost (even though a portion of contaminated material can be recycled). These configurational factors are considered along with metal-casting parameters, such as a cluster-preheat temperature and time, the vacuum level in the casting chamber, and the angular velocity of the turntable to produce actual casting results. As the walls of the bodies of golf club heads, such as the body 110 of golf club head 100, are made increasingly thinner, careful selection and balance of these factors and parameters are important for producing adequate casting results.

Details of investment casting using various casting clusters, for making titanium-based golf club heads, tend to be proprietary. But, experiments at with various casting clusters revealed some consistencies and some general trends. For example, a club head 100, having a volume of 460 $cm^3$, a crown thickness of 0.6 mm, and a sole thickness of 0.8 mm, was fabricated using each of six different casting clusters 200 (having respective metal-casting furnaces ranging from 10 kg to 80 kg capacity). Each of the six different casting clusters 200 and corresponding casting processes produced the data tabulated in FIGS. 5A and 5B. The parameters listed in FIGS. 5A and 5B include the following:

"R max" is the maximum radius of the cluster

"R min" is the minimum radius of the cluster

"Wet perimeter" is the total perimeter of the runner

R (flow radius)" is the cross-sectional area/wet perimeter of the runner

"Sharp turn" is a 90-degree or greater turn in the runner system

"Process loss ratio" is the ratio of process loss to pouring material

"Velocity max" is the velocity at the maximum radius (=ω·R max)

"Velocity min" is the velocity at the minimum radius (=ω·R min)

"Acceleration max" is the acceleration at the maximum radius (=(=ω2·R max)

"Acceleration min" is the acceleration at the minimum radius (=ω2·R min)

"Force max" is the force at the maximum radius (=material usage (with process loss)·Acceleration max). Note that this is an approximation of the magnitude of force being applied to the molten metal at a gate. Due to each particular cluster design, the true force is almost always lower than the calculated value, with more complex clusters exhibiting greater reduction of the force.

"Force min" is the force at the minimum radius (=material usage (with process loss)·Acceleration min). Note that this is an approximation of the magnitude of force being applied to the molten metal at the gate. Due to each particular cluster design, the true force is almost always lower than the calculated value, with more complex clusters exhibiting greater reduction of the force.

"Pressure max" is the pressure of molten metal in the runner at maximum radius (=Force max/Runner cross-sectional area)

"Pressure min" is the pressure of molten metal in the runner at minimum radius (=Force min/Runner cross-sectional area)

"Kinetic energy max" is the kinetic energy of molten metal at the maximum radius (=½·material usage (w/process loss)·velocity max2)

"Density (ρ)" is the density of molten metal (titanium alloy) at the melting point of 1650° C. Note that most casting clusters would apply overheat by heating to above 1700° C.; however, the general trend is similar for purposes of this analysis.

"Viscosity (μ)" is the viscosity of molten titanium at 1650° C. Note that most casting clusters would apply overheat by heating to above 1700° C.; however, the general trend is similar for purposes of this analysis.

"Re number max" is the Reynolds number for pipe flow at maximum radius. The Reynolds number is defined as:

$$\mathrm{Re} = \frac{DV_{ave}\rho}{\mu}$$

where D is pipe diameter (i.e., 4·R (flow radius)), $V_{ave}$ is average velocity of pipe flow (assumed to be identical to Velocity max), ρ is density, and μ is viscosity. "Re number min" is defined consistently as Re number max, but at a minimum radius.

In view of the Note #1 in FIG. 5A, the degree of complexity of the casting cluster 200 is based on a scale of 1 to 5, with "1" being a simple cluster and "5" being a very complex cluster. Complex clusters typically have numerous turns, numerous changes in cross sectional area/shape, and multiple directions of flow of molten metal as the metal flows into the mold cavities. Again, referring to the Note #2 in FIG. 5A, the main gate cross-sectional area for casting clusters 2-6 is multiplied by 2 because, in the shells used by these clusters, two molds are attached, back-to-back, at each mold-cavity location on the runner; thus, molten metal flows simultaneously into each pair of mold cavities at each such location. With cluster 1, each runner feeds only one club-head mold cavity at each such location on the runner. Also, referring to the Note #3 in FIG. 5A, the interference gating ratio is defined as runner cross-sectional area divided by the cross-sectional area of the main gate. Cluster 1 achieved a near optimal interface gating ratio (~100%), while the other casters did not (an insufficient gating ratio for this analysis is less than 100%, wherein runner area is less than main gate area).

FIGS. 5A and 5B indicate that at least a minimum force (and thus at least a minimum pressure) should be applied to the molten metal entering the mold for each cluster to achieve a good casting yield. The force applied to the molten metal is generated in part by the mass of actual molten metal entering the mold cavities in the cluster and by the centrifugal force produced by the rotating turntable of the casting furnace. A reduced minimum force is desirable because a lower force generally allows a reduction in the amount, per club head, of molten metal necessary for casting. However, other factors tend to indicate increasing this force, including: thinner wall sections in the item being cast, more complex clusters (and thus more complex flow patterns of the molten metal), reduced mold-preheat temperatures (resulting in a greater loss of thermal energy from the molten metal as it flows into the mold), and substandard mold qualities such as rough mold-cavity walls and the like. The data in FIGS. 5A and 5B indicates that the minimum force required for casting a titanium-alloy golf club head, of which at least a portion of the wall is 0.6 mm thick, is approximately 160 Nt. Cluster 1 achieved this minimum force.

A lower threshold of the amount of molten metal necessary for pouring into the shell can be derived from the minimum-force requirement. Excluding unavoidable pouring losses, the best metal usage (as achieved by cluster 1) was 386 g (0.386 kg) for club heads each having a mass of approximately 200 g (including main gate and some runner). This is equivalent to a material-usage ratio of 200/386=52%. The accelerations (max) applied to the investment-casting molds by the clusters 2-6 were all higher than the acceleration applied by caster 1, but more molten metal was needed by each of clusters 2-6 to produce respective casting yields that were equivalent to that achieved by caster 1.

Figure 6:
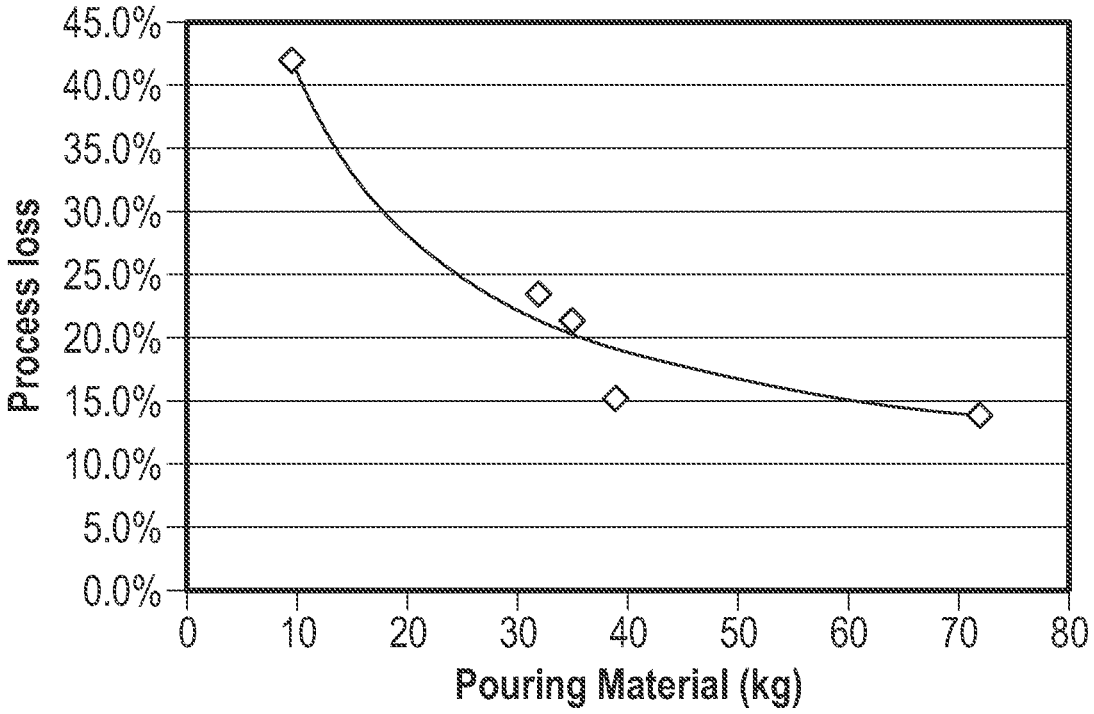
FIG. 6 is a plot comparing process loss versus mass of pouring material (molten metal), the latter being indicative of casting-furnace size for various casting clusters, according to one or more examples of the present disclosure.

Some process loss (splashing, cooled metal adhering to side walls of the crucible and coup supplying the liquid titanium alloy, revert cleaning loss, and the like) is unavoidable. Process loss imposes an upper limit to the efficiency that can be achieved by smaller casting furnaces. For example, the percentage of process loss increases rapidly with decreases in furnace size, as illustrated in FIG. 6.

On the other hand, smaller casting furnaces advantageously have simpler operation and maintenance requirements. Other advantages of smaller furnaces are: (a) they tend to process smaller and simpler clusters of mold cavities, (b) smaller clusters tend to have separate respective runners feeding each mold cavity, which provides better interface-gating ratios for entry of molten metal into the mold cavities, (c) the furnaces are more easily and more rapidly preheated prior to casting, (d) the furnaces offer a potentially higher achievable shell-preheat temperature, and (e) smaller clusters tend to have shorter runners, which have lower Reynolds numbers and thus pose reduced potentials for disruptive turbulent flow. While larger casting furnaces tend not to have these advantages, smaller casting furnaces tend to have more unavoidable process loss of molten metal per mold cavity than do larger furnaces.

In view of the above, the most cost-effective casting systems (furnaces, clusters, yields, net material costs) appear to be medium-sized systems, so long as appropriate cluster and gate design considerations are incorporated into configurations of the clusters used in such furnaces. This can be seen from comparing clusters 1, 4, and 5. The overall usages of material (without considering process losses) by these three clusters are very close (664-667 g/cavity). Material usage (considering process loss) by cluster 1 is 386 g, while that of clusters 4 and 5 is 510 g. Thus, whereas clusters 4 and 5 could still improve, it appears that cluster 1 has reached its limit in this regard.

At least the minimum threshold force applied to molten metal entering the molds of the clusters can be achieved by either changing the mass or increasing the velocity of the molten metal entering the shell, typically by decreasing one and increasing the other. There is a realistic limit to the degree to which the mass of "pour material" (molten metal) can be reduced. As the mass of pour material is reduced, correspondingly more acceleration is necessary to generate sufficient force to move the molten metal effectively into the investment-casting molds. But, increasing the acceleration increases the probability of creating turbulent flow (due to a high $V_{ave}$) of the molten metal entering the molds. Turbulent flow is undesirable because it disrupts the flow pattern of the molten metal. A disrupted flow pattern can require even greater force to "push" the metal though the main gate into the mold cavities.

Note that the respective Reynolds number for each cluster is in the range of $2\times10^5$ to $6\times10^5$. It is unclear what the critical Reynolds number would be for a corresponding type of boundary-layer problem involving molten titanium flowing in a pipe geometry (and eventually into a plate-like mold cavity, as in an actual mold cavity for a club-head), it is nonetheless desirable that the Reynolds number be as low as possible. The data in FIGS. 5A and 5B indicates that the optimal Reynolds number is approximately $2.2\times10^5$. For cluster 1, this Reynolds number is equivalent to $V_{ave}$=8 m/s. For other clusters, especially cluster 6, a high Reynolds number indicates a high potential of turbulent flow, which offsets the advantage of high flow velocity of the molten metal (produced by the high angular velocity of the turntable). Cluster 6 is unnecessarily complex; some effects of a high $V_{ave}$ are offset by the complexity of the cluster.

The Reynolds number can be easily modified by changing the shape and/or dimensions of the runner(s). For example, changing R (flow radius) will affect the Reynolds number directly. The smaller R (flow radius) will result in less minimum force (the two almost having a reciprocal relationship). Hence, an advantageous consideration is first to reduce the Reynolds number to maintain a steady flow field of the molten metal, and then satisfy the requirement of minimum force by adjusting the amount of pour material.

From this analysis, smaller clusters are not the only way to obtain high yield. But, smaller clusters are more likely to produce a higher yield due mainly to their relative simplicity. It would be more difficult to fine-tune a larger cluster to reach the same level of performance that is achieved by a smaller cluster.

An additional factor affecting the results of the casting process is preheating the investment-casting cluster before introducing the molten metal to it. Cluster 1 achieved 94% yield with the smallest Reynolds number and the minimum amount of pour material (and thus the lowest force) in part because cluster 1 had the highest caster-shell temperature. Another factor is the complexity of the cluster(s). Evaluating a complex cluster is very difficult, and the high Reynolds numbers usually exhibited by such clusters are not the only variable to be controlled to reduce disruptive turbulent flow of molten metal in such clusters. For example, the number of "sharp" turns (90-degree turns or greater) in runners and mold cavities of the cluster is also a factor. In FIGS. 5A and 5B, caster 1 has one sharp turn (and another less-sharp turn), whereas the caster 6 has three sharp turns. It is possible that caster 6 needs to rotate its shell at a higher angular velocity just to overcome the flow resistance posed by these sharp turns. But, this would not alleviate, disrupted flow patterns posed by the sharp turns. Hence, simpler cluster(s) (with fewer sharp turns to allow more "natural" flow routes of molten metal) are desired.

Another factor is matching the runner and gates of a cluster. The interface gating ratio for cluster 1 is the closest to 100% (indicating optimal gating), compared to the substantially inferior data from the other clusters. The "worst" was cluster 3, which had a Reynolds number almost as low as that of cluster 1, but cluster 3 achieved a yield of only 78%, due to a poor interface gating ratio (approximately 23%). The low interface gating ratio exhibited by cluster 3 increased the difficulty of determining whether the cause of the low yield of cluster 3 was insufficient pour material to fill the main gates or the occurrence of "two-phase flow-liquid and vacancy." In any event, the overall cross-sectional areas of runners and main gates should be kept as nearly equal (and constant) to each other as possible to achieve constant flow velocity of liquid metal throughout the cluster at any moment during pouring. For thin-walled titanium castings, this principle applies especially to the interfaces between the runner and the main gates, where the interface gating ratio should be no less than unity (1.0).

Yet another factor is the cross-sectional shape of the runner. Comparing clusters 4 and 5 with clusters 2 and 5, triangular-section runners appeared to produce lower Reynolds numbers than rounded or rectangular runners. Although using triangular-section runners can cause problems with the interface gating ratio (as metal flows from such a runner into a rectilinear-section or round-section main gate), the significant reduction in Reynolds numbers achieved using triangular-section runners is worth pursuing as the difference in pour material used by clusters 2 and 5 indicates (39 kg versus 32 kg).

Figure 7:
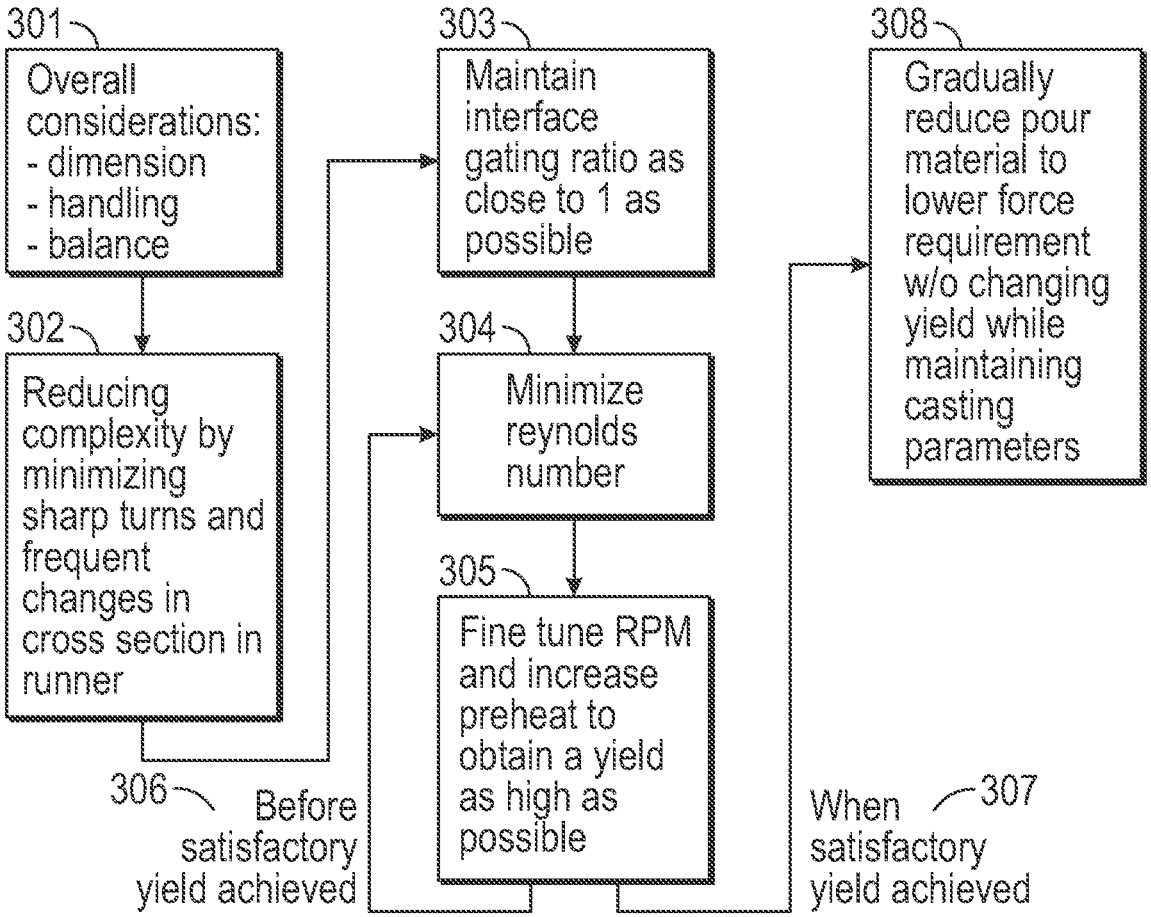
FIG. 7 is a flow chart of a method of configuring a casting cluster, according to one or more examples of the present disclosure.

A flow-chart for a method 300 of configuring a casting cluster is shown in FIG. 7. In a first step 301 of the method 300, overall considerations of the intended cluster are made such as dimensions, handling, and balance. Next, the complexity of the cluster is reduced by minimizing sharp turns and any unnecessary (certainly any frequent) changes in runner cross-section (step 302). The interface gating ratio is maintained as close as possible to unity (step 303). Also, the Reynolds number is minimized as much as practicable (step 304). The angular velocity (RPM) of the turntable is fine-tuned and the shell pre-heat temperature is increased to produce the highest possible product yield (step 305). Iteration (306) of steps 304, 305 is usually required to achieve a satisfactory yield. In step 308, after a satisfactory yield is achieved (307), the mass of pour material (molten metal) is gradually reduced to reduce the force required to urge flow of molten metal throughout the cluster, but without decreasing product yield and while maintaining other casting parameters.

To reduce material and labor costs, in some examples, it is desirable to configure the casting cluster to manufacture more heads. However, due to size constraints associated with the furnace and other manufacturing facilities, it is also desirable to limit the overall outer peripheral size of the casting cluster. To promote the reduction of both cost and size, disclosed herein are several examples of a casting cluster that accommodates concurrent casting of at least twenty-eight golf club heads of the driver and/or fairway construction. The casting cluster of each of the examples includes a receptor 202, runners 204, and main gates 214. At least two of at least twenty-eight molds 206 are coupled to a respective one of the runners 204. Moreover, each mold of the at least twenty-eight molds 206 receives molten metal 230 from a runner channel 208 of a corresponding runner 204 via a corresponding one of the main gates 214. By placing more than one mold 206 at specific locations on each runner 204, more golf club heads can be cast at a lower cost per head and at a higher rate, while achieving an acceptable yield rate (e.g., at least 80%).

In operation, molten metal 230 flows directly into the runner channel 208 of a runner 204 at a proximal end 240 of the runner 204 and flows in a radially outwardly direction from the proximal end 240 to a distal end 242. The molten metal 230 flows into the molds 206 of each runner 204 via the corresponding main gates 214. In some examples, the runner channels 208 can include one or more filters (made, e.g., of ceramic) for enhancing smooth laminar flow of molten metal into and through the molds 206 and for preventing entry of any dross into the molds 206. The casting cluster can be rotated as the molten metal 230 flows into the casting cluster 200A to increase the force urging the molten metal 230 through the runners 204 and into the molds 206. Because of the additional molds of the casting clusters disclosed herein, the casting clusters are rotated at a rotational speed of at least 550 RPM, in some examples, and at a rotational speed of at least 580 RPM.

Figure 8:
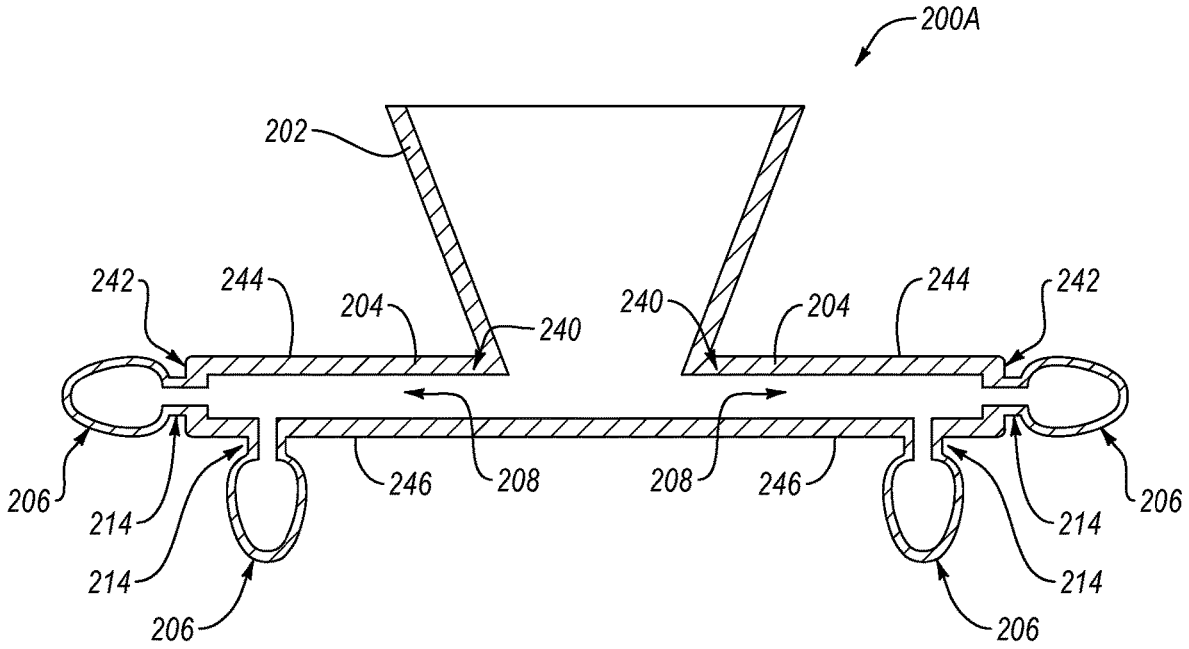
FIG. 8 is a cross-sectional side view of a casting cluster, according to one or more examples of the present disclosure.
Figure 9:
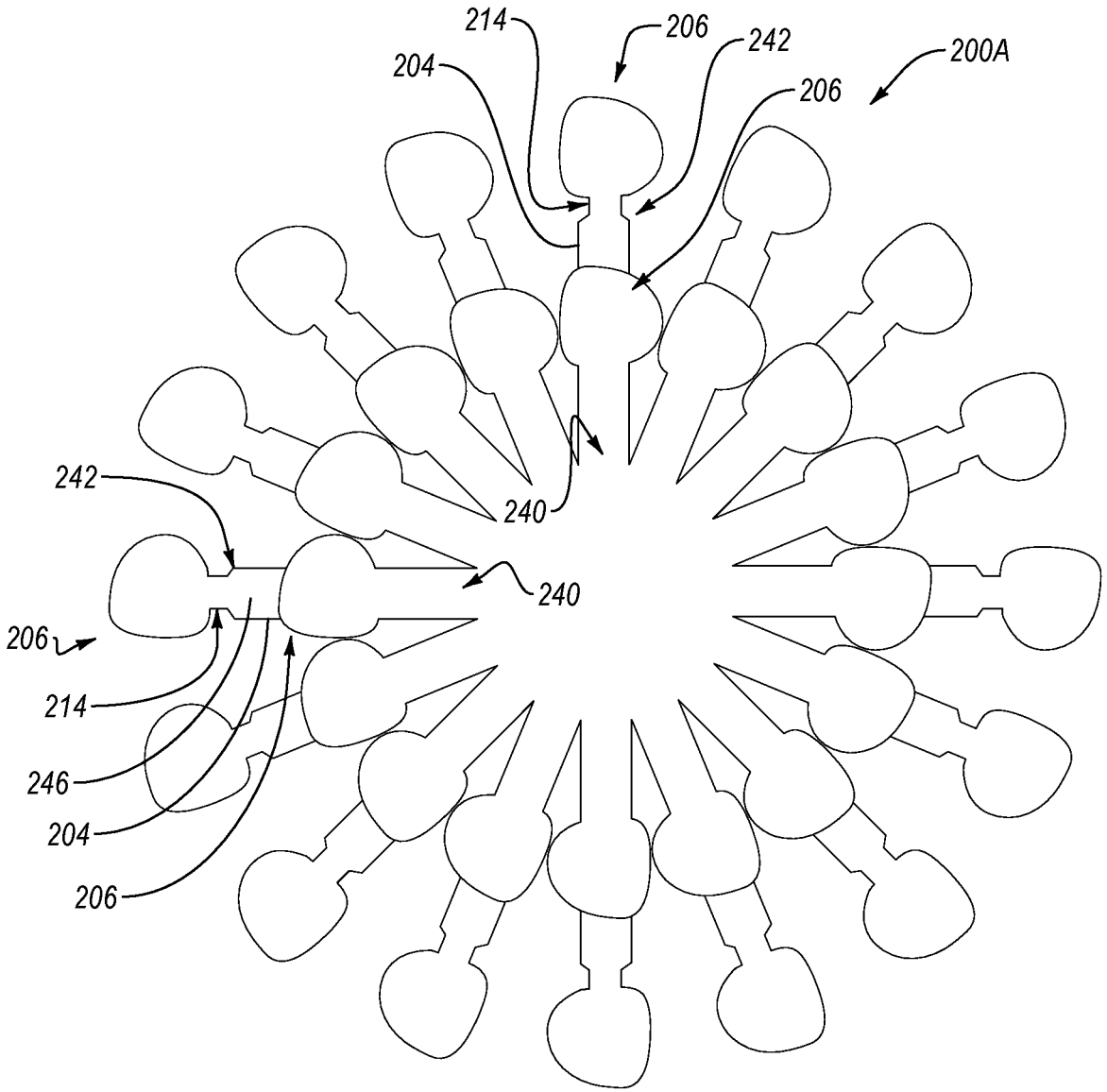
FIG. 9 is a cross-sectional side view of a casting cluster, according to one or more examples of the present disclosure.

Referring to FIGS. 8 and 9, and according to one example, a casting cluster 200A includes one mold 206 located at a distal end 242 of each runner 204 and one mold 206 located at a bottom surface 246 of each runner 204. The casting cluster 200A includes fourteen runners 204. Accordingly, the casting cluster 200A includes twenty-four molds 206. The distal end 242 of each runner 204 is opposite a proximal end 240 of the runner 204. The proximal end 240 is adjacent to (e.g., adjoins) the receptor 202. The mold 206, located at the bottom surface 246 of each runner 204, is positioned between the proximal end 240 and the distal end 242. In the illustrated embodiment, each mold 206, located at the bottom surface 246 of a corresponding runner 204, is positioned closer to the distal end 242 of the runner 204 than the proximal end 240 of the runner. However, in other examples, each mold 206, located at the bottom surface 246 of a corresponding runner 204, can be positioned closer to the proximal end 240 of the runner 204 than the distal end 242 of the runner 204. The molds 206 coupled to the bottom surface 246 of the runners 204 protrude from the bottom surface 246 downwardly away from the top surfaces 244 of the runners 204. These molds 206, being downwardly protruding, benefit from the additional downwardly directed gravitation force to help urge the molten metal 230 into the molds 206. Because the main gates 214 of the molds 206 at the distal ends 242 of the runners 204 are parallel to or in-line with the corresponding runner channels 208, such that the flow of molten metal 230 through the runner channels 208 is the same direction as through the corresponding main gates 214, these molds 206 are considered "straight-feed" molds. In contrast, because the main gates 214 of the molds 206 between the proximal ends 240 and the distal ends 242 of the runners 204 are perpendicular to the corresponding runner channels 208, such that the flow of molten metal 230 through the runner channels 208 is perpendicular to the flow through the corresponding main gates 214, these molds 206 are considered "side feed" molds.

Figure 10:
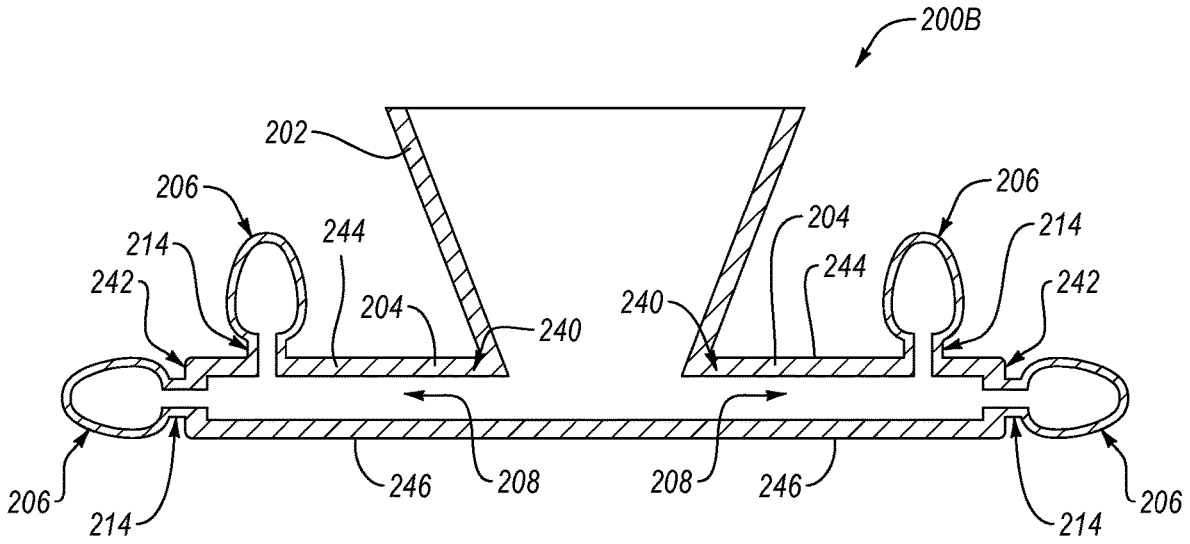
FIG. 10 is a cross-sectional side view of a casting cluster, according to one or more examples of the present disclosure.

Referring to FIG. 10, another example of a casting cluster 200B is shown. The casting cluster 200B is similar to the casting cluster 200A. For example, the casting cluster 200B includes one mold 206 located at a distal end 242 of each runner 204. However, unlike the casting cluster 200A, the casting cluster 200B includes one mold 206 at the top surface 244 of each runner 204, instead of at the bottom surface 246. The casting cluster 200B includes fourteen runners 204 and twenty-four molds 206. The mold 206, located at the top surface 244 of each runner 204, is positioned between the proximal end 240 and the distal end 242. In the illustrated embodiment, each mold 206, located at the top surface 244 of a corresponding runner 204, is positioned closer to the distal end 242 of the runner 204 than the proximal end 240 of the runner. However, in other examples, each mold 206, located at the top surface 244 of a corresponding runner 204, can be positioned closer to the proximal end 240 of the runner 204 than the distal end 242 of the runner 204. The molds 206 coupled to the top surface 244 of the runners 204 protrude from the top surface 244 upwardly away from the bottom surfaces 244 of the runners 204.

Figure 11:
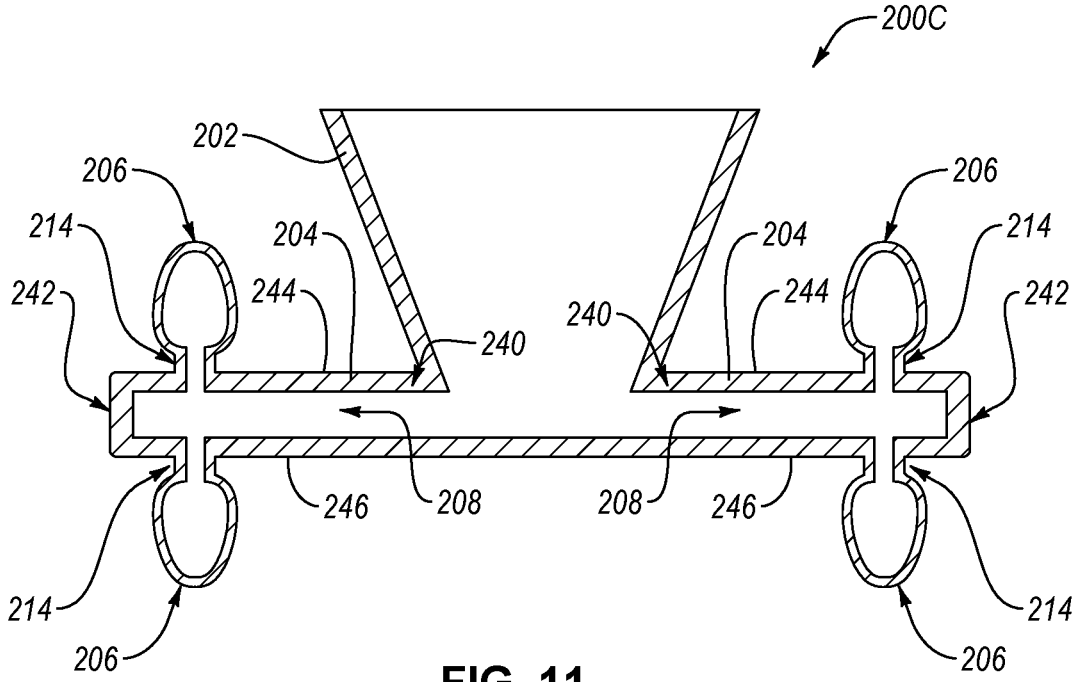
FIG. 11 is a cross-sectional side view of a casting cluster, according to one or more examples of the present disclosure.

Referring to FIG. 11, another example of a casting cluster 200C is shown. The casting cluster 200C is similar to the casting cluster 200A and the casting cluster 200B. For example, the casting cluster 200C includes one mold 206 at the top surface 244 of each runner 204 and one mold 206 at the bottom surface 246 of each runner 204. However, unlike the casting cluster 200A and the casting cluster 200B, the casting cluster 200C does not include a mold 206 at the distal end 242 of each runner 204. In the illustrated implementation, the main gates 214 of the molds 206 of each runner 204 are vertically aligned. In other words, the molds 206, located at the top surface 244 and the bottom surface 246 of each runner 204, are positioned at the same location between the proximal end 240 and the distal end 242 of the runner 204. But, in other implementations, the main gates 214 of the molds 206 of each runner 204 are not vertically aligned such that the molds 206, located at the top surface 244 and the bottom surface 246 of each runner 204, are positioned at different locations between the proximal end 240 and the distal end 242 of the runner 204. The molds 206 of each runner 204 of the casting cluster 200C can be located closer to the distal end 242 of the runner 204 than the proximal end 240 of the runner 204. However, in other examples, the molds 206 of each runner 204 of the casting cluster 200C can be positioned closer to the proximal end 240 of the runner 204 than the distal end 242 of the runner 204.

Figure 12:
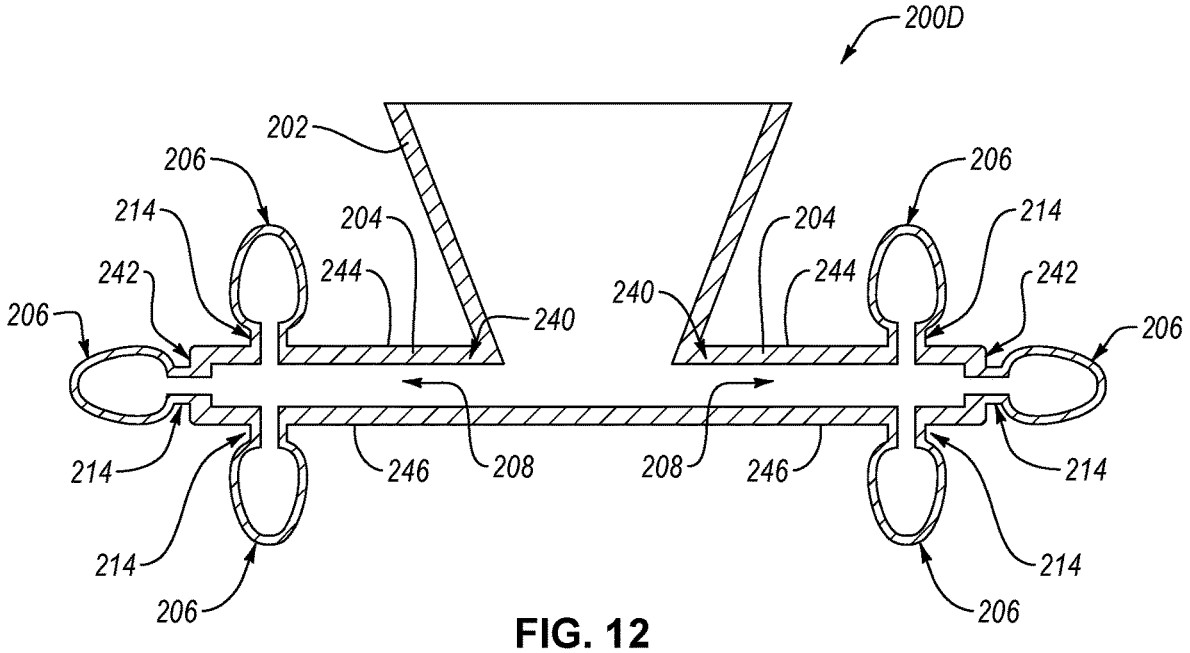
FIG. 12 is a cross-sectional side view of a casting cluster, according to one or more examples of the present disclosure.

Referring to FIG. 12, another example of a casting cluster 200D is shown. The casting cluster 200D is similar to the casting cluster 200C. For example, the casting cluster 200C includes one mold 206 at the top surface 244 of each runner 204 and one mold 206 at the bottom surface 246 of each runner 204. However, unlike the casting cluster 200C, the casting cluster 200D also includes a mold 206 at the distal end 242 of each runner 204. Therefore, each runner 204 of the casting cluster 200D includes three molds 206. In one implementation, the casting cluster 200D includes fourteen runners 204 and forty-two molds 206. In some implementations, the casting cluster 200D includes fewer than fourteen runners 204, such as ten runners, and the casting cluster 200D includes fewer than forty-two molds 206, such as thirty molds 206. The main gates 214 of the molds 206 at the top surface 244 and the bottom surface 246 of each runner 204 can be vertically aligned or vertically misaligned. Moreover, the molds 206 of each runner 204 of the casting cluster 200D, between the proximal end 240 and the distal end 242, can be located closer to or further away from the distal end 242 of the runner 204 than the proximal end 240 of the runner 204.

Figure 13:
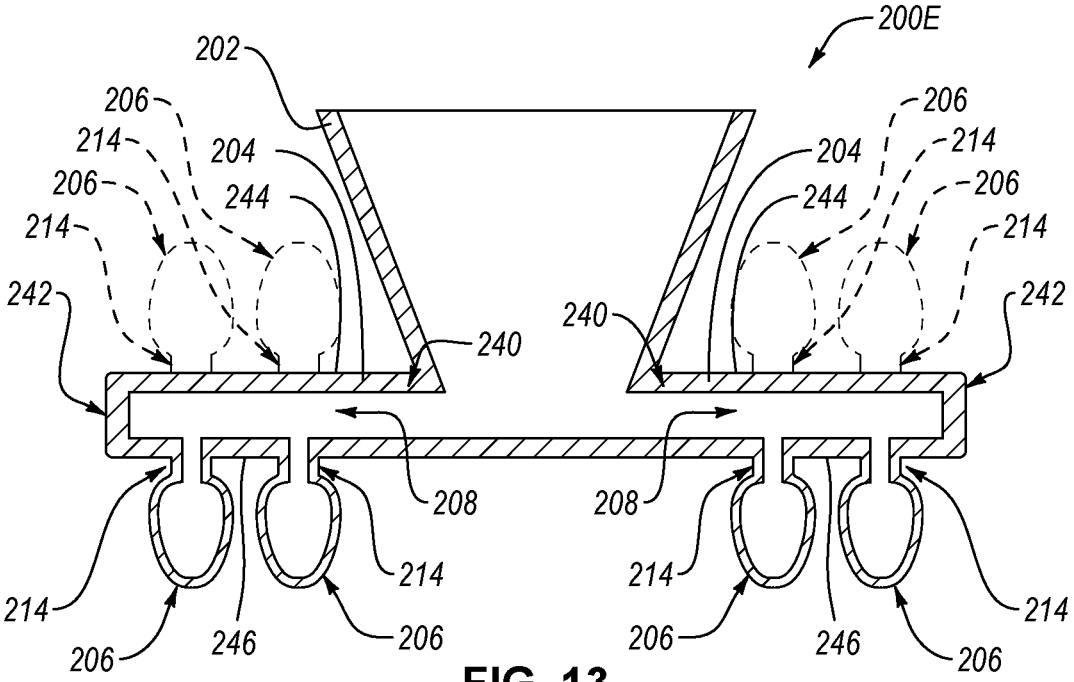
FIG. 13 is a cross-sectional side view of a casting cluster, according to one or more examples of the present disclosure.

Referring to FIG. 13, another example of a casting cluster 200E is shown. The casting cluster 200E is similar to the casting cluster 200A. For example, the casting cluster 200E includes a mold 206 at the bottom surface 246 of each runner 204. However, unlike the casting cluster 200A, the casting cluster 200E includes an additional mold 206 at the bottom surface 246 of each runner 204 and no mold 206 at the distal end 242 of each runner 204. Accordingly, each runner 204 includes two molds 206 at and protruding from the bottom surface 246 of the runner 204. In one implementation, the casting cluster 200E includes fourteen runners 204 and forty-two molds 206. Both molds 206 of each runner 204 of the casting cluster 200E, between the proximal end 240 and the distal end 242, can be located closer to or further away from the distal end 242 of the runner 204 than the proximal end 240 of the runner 204. Alternatively, one of the molds 206 of each runner 204 can be located closer to the proximal end 240 of the runner 204 and the other of the molds 206 of each runner 204 can be located closer to the distal end 242 of the runner 204. As shown in dashed line, in another example, instead of or in addition to each runner 204 having two molds 206 at the bottom surface 246 of each runner 204, a casting cluster can have two molds 206 at the top surface 244 of each runner 204. In yet another example, the casting cluster 200E can include another mold 206, at the distal end 242 of each runner 204, in addition to the two molds 206 at the bottom surface 246 or the top surface 244 of each runner 204.

Figure 14:
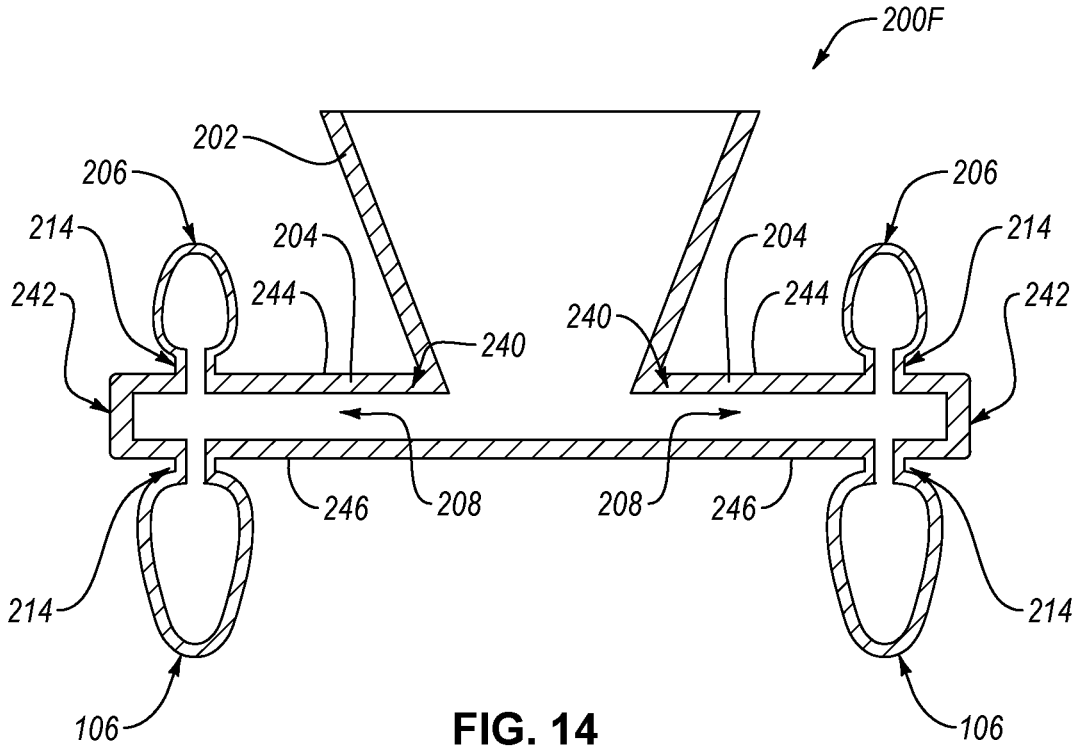
FIG. 14 is a cross-sectional side view of a casting cluster, according to one or more examples of the present disclosure.
Figure 15:
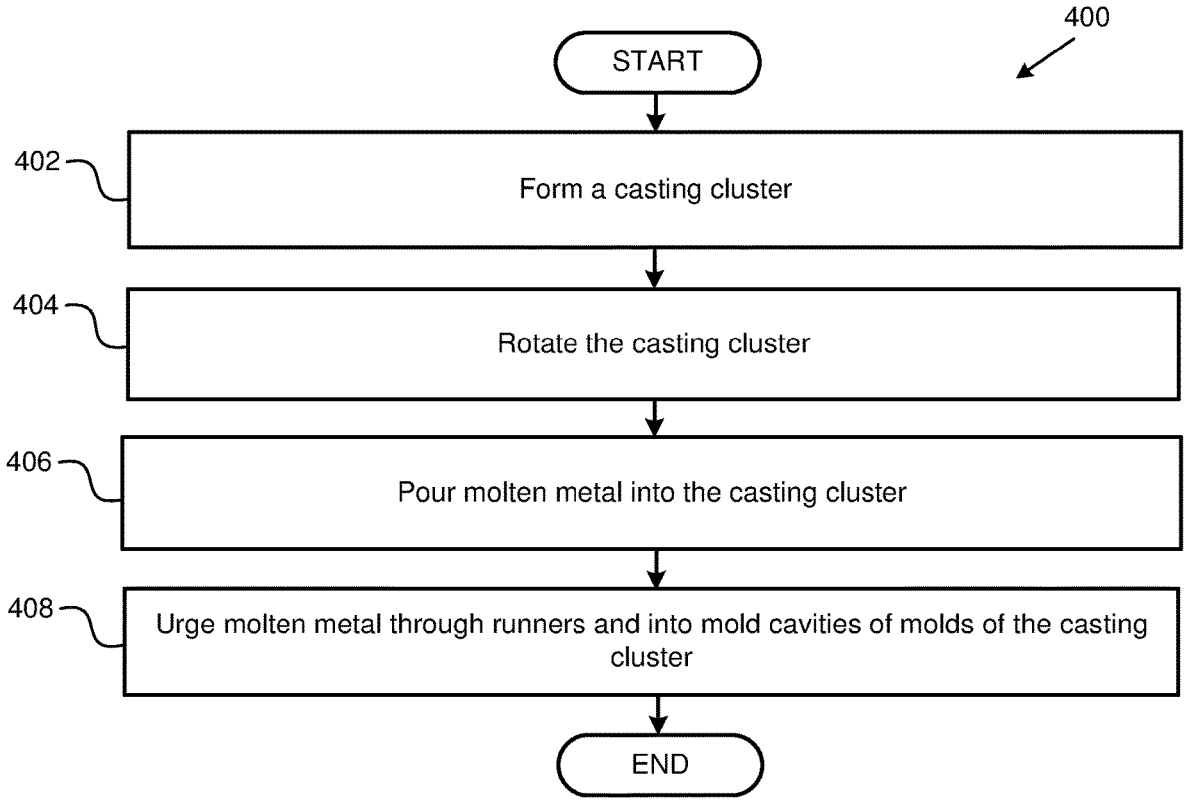
FIG. 15 is a schematic flow diagram of a method of casting multiple bodies of a golf club head, according to one or more examples of the present disclosure.

Referring to FIG. 14, another example of a casting cluster 200F is shown. The casting cluster 200F is similar to the casting cluster 200C of FIG. 11. For example, the casting cluster 200F includes a mold 206 at the bottom surface 246 of each runner 204 and a mold 206 at the top surface 244 of each runner 204. However, unlike the casting cluster 200C, the molds 106 of each runner 204 of the casting cluster 200F are differently configured (e.g., differently sized and/or differently shaped). In the illustrated example, the mold 206 at the bottom surface 246 of each runner 204 is larger than the mold 206 at the top surface 244 of each runner 204. As an example, one mold 106 of each runner 204 can be configured to cast a driver-type golf club head and the other mold 106 of the runner 204 can be configured to cast a fairway-type golf club head. As another example, one mold 106 of each runner 204 can be configured to cast a driver-type golf club head or a fairway-type golf club head of one model and the other mold 106 of the runner 204 can be configured to cast a driver-type golf club head or fairway-type golf club head of a different model.

The molds 106 of the casting clusters disclosed herein are configured to produce a body 110 of a golf club head 100 with a wall thickness, of at least a portion of the body 110, of at most 0.6 mm, in some examples, and at most 0.8 mm, in other examples. Accordingly, although the body 110 may have a wall thickness at some portions of the body 110 that is greater than 0.6 mm or greater than 0.8 mm, at least one portion of the body 110 has a thickness as low as 0.6 mm or 0.8 mm.

In some examples of driver-type golf club heads, the casting clusters disclosed herein, configured with at least twenty-eight molds, are able to make twenty-eight between 0.13 kg and 0.20 kg, inclusive, golf club head bodies by using no more than between 0.40 kg and 0.75 kg, inclusive, per golf club head body of raw material.

In other examples of fairway-type golf club heads, the casting clusters disclosed herein, configured with at least twenty-eight molds, are able to make twenty-eight between 0.10 kg and 0.18 kg, inclusive, golf club head bodies by using no more than between 0.35 kg and 0.7 kg, inclusive, per golf club head body of raw material.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A method of casting a body of a golf club head made of titanium or a titanium alloy, the method comprising:

rotating a casting cluster at a rotational speed of at least 550 rotations-per-minute (RPM)-, wherein the casting cluster comprises:

a receptor;

a plurality of runners coupled to the receptor and configured to receive molten metal from the receptor;

at least twenty-eight main gates, wherein at least two of the main gates are coupled to each of the runners and each main gate is configured to receive molten metal from a corresponding one of the plurality of runners; and at least twenty-eight molds, wherein:

at least two of the at least twenty-eight molds are coupled to each one of the plurality of runners via respective main gates of the at least twenty-eight main gates;

each mold of the at least twenty-eight molds is configured to receive molten metal from a corresponding one of the main gates; and each mold of the at least twenty-eight molds is configured to cast a body of a golf club head that has a volume of at least 100 $cm^3$;

while rotating the casting cluster, introducing a molten titanium-based metal into the casting cluster;

while rotating the casting cluster, flowing the molten titanium-based metal through the plurality of runners, through the at least twenty-eight main gates, and into the at least twenty-eight molds; and producing a cast-product yield of at least 80%.

2. The method according to claim 1, wherein each mold of the at least twenty-eight molds is configured to cast a body of a golf club head that has a volume of no more than 250 $cm^3$.

3. The method according to claim 1, wherein each mold of the at least twenty-eight molds is further configured to cast a body having a mass from 0.10 kg to 0.18 kg.

4. The method according to claim 1, wherein each mold of the at least twenty-eight molds is further configured to cast a body that has a crown opening that occupies at least a majority of a crown portion of the body.

5. The method according to claim 1, wherein each mold of the at least twenty-eight molds is further configured to cast a body that has a face opening in a face portion of the body.

6. The method according to claim 1, further comprising a step of, prior to flowing the molten titanium-based metal into the at least twenty-eight molds of the casting cluster, flowing the molten titanium-based metal through at least fourteen runners of the casting cluster.

7. The method according to claim 1, wherein the step of flowing the molten titanium-based metal into the at least twenty-eight molds comprises flowing the molten titanium-based metal upwards, against gravity, into the at least twenty-eight molds.

8. The method according to claim 1, wherein the step of flowing the molten titanium-based metal into the at least twenty-eight molds comprises flowing the molten titanium-based metal downwards, with gravity, into the at least twenty-eight molds.

9. The method according to claim 1, wherein the step of flowing the molten titanium-based metal into the at least twenty-eight molds comprises flowing the molten titanium-based metal upwards, against gravity, into some of the at least twenty-eight molds and flowing the molten titanium-based metal downwards, with gravity, into some of the at least twenty-eight molds.

10. The method according to claim 1, wherein the molten titanium-based metal is 9-1-1 titanium.

11. The method according to claim 1, wherein the body of the golf club head, cast by each mold of the at least twenty-eight molds, comprises an entirety of a face portion of the golf club head.

12. The method according to claim 1, wherein the molten titanium-based metal has a yield strength of at least 820 MPa, a tensile strength of at least 958 MPa, and an elongation of at least 10.2%.

13. The method according to claim 1, wherein the molten titanium-based metal has a yield strength of at least 1,150 MPa, a tensile strength of at least 1,180 MPa, and an elongation of at least 8%.

14. The method according to claim 1, wherein the molten titanium-based metal has a yield strength between 1,150 MPa and 1,415 MPa, a tensile strength 1,180 MPa and 1,460 MPa, and an elongation of between 8% and 12%.

15. The method according to claim 1, further comprising a step of, prior to introducing the molten titanium-based metal into the casting cluster, heating a temperature of the casting cluster to at least 1000° C.

16. The method according to claim 1, further comprising forming no more than 0.15 mm of alpha case on any surface of the body of the golf club head cast by each one of the at least twenty-eight molds of the casting cluster.

17. The method according to claim 1, further comprising a step of, prior to introducing the molten titanium-based metal into the casting cluster, heating a temperature of the casting cluster to no more than 800° C.

* * * * *